US009051927B2

(12) United States Patent
Gilpatrick et al.

(10) Patent No.: US 9,051,927 B2
(45) Date of Patent: Jun. 9, 2015

(54) WATER PUMP HAVING TWO OPERATING CONDITIONS

(75) Inventors: Richard J. Gilpatrick, Whitewater, WI (US); Jason J. Raasch, Cedarburg, WI (US); Gary Gracyalny, Elm Grove, WI (US)

(73) Assignee: BRIGGS & STRATTON CORPORATION, Wauwatosa, WI (US)

( * ) Notice: Subject to any disclaimer, the term of this patent is extended or adjusted under 35 U.S.C. 154(b) by 289 days.

(21) Appl. No.: 13/523,665

(22) Filed: Jun. 14, 2012

(65) Prior Publication Data

US 2013/0216402 A1 Aug. 22, 2013

Related U.S. Application Data

(63) Continuation-in-part of application No. 13/399,931, filed on Feb. 17, 2012.

(51) Int. Cl.
*F04B 1/12* (2006.01)
*F04B 17/00* (2006.01)
(Continued)

(52) U.S. Cl.
CPC ..... *F04B 17/00* (2013.01); *F04B 49/12* (2013.01); *F04B 49/02* (2013.01); *F04B 1/28* (2013.01); *F04B 1/146* (2013.01); *F04B 17/03* (2013.01); *F04B 17/06* (2013.01)

(58) Field of Classification Search
CPC ..... F04B 1/146; F04B 1/28; F04B 1/29; F04B 49/022; F04B 49/12; F04B 49/20; F04B 17/00; F04B 17/06; F04B 2027/18; F04B 2027/1809; F04B 2205/03; F04B 2205/07; F04B 2207/01; F04B 17/03; F04B 17/05; F04B 11/295; F04B 27/18; F04B 35/002; F04B 35/04; F04B 2027/1804
USPC ..... 417/218, 269, 270, 274, 212; 91/499, 91/504, 505, 506
See application file for complete search history.

(56) References Cited

U.S. PATENT DOCUMENTS 828,705 A 8/1906 Bode
1,262,539 A 4/1918 Micka
(Continued)

FOREIGN PATENT DOCUMENTS

DE 38 40 787 A1 6/1990
DE 299 08 357 U1 8/2000

OTHER PUBLICATIONS

Non-Final Office Action on U.S. Appl. No. 13/399,931 mail date Oct. 16, 2014, 11 pages.*
(Continued)

*Primary Examiner* — Bryan Lettman
*Assistant Examiner* — Timothy P Solak
(74) *Attorney, Agent, or Firm* — Foley & Lardner LLP

(57) ABSTRACT

A water pump includes a base, a cam, a joint, and a piston. The base includes a PTO-attachment portion, a cam-attachment portion, a first contact surface, and a second contact surface. The cam includes a central opening, a first cam contact surface, and a second cam contact surface, wherein the cam-attachment portion of the base extends into the central opening. The joint pivotally couples the cam to the cam-attachment portion of the base. In a first operating position of the cam, the first contact surface engages the first cam contact surface so that the cam is positioned at a first angle relative to the axis of PTO rotation. In a second operating position of the cam, the second contact surface engages the second cam contact surface so that the cam is positioned at a second angle, greater than the first angle, relative to the axis of PTO rotation.

9 Claims, 21 Drawing Sheets

(51) Int. Cl.

| | |
|---|---|
| ***F04B 17/03*** | (2006.01) |
| ***F04B 17/06*** | (2006.01) |
| *F04B 49/12* | (2006.01) |
| *F04B 49/02* | (2006.01) |
| *F04B 1/28* | (2006.01) |
| *F04B 1/14* | (2006.01) |

(56) References Cited

U.S. PATENT DOCUMENTS

| | | | | | |
|---|---|---|---|---|---|
| 1,369,567 | A | | 2/1921 | Smith | |
| 2,678,457 | A | | 1/1950 | Demo et al. | |
| 2,540,240 | A | | 2/1951 | Boyle | |
| 3,030,890 | A | | 4/1962 | Galik | |
| 3,114,164 | A | | 12/1963 | Riordan | |
| 3,283,352 | A | | 11/1966 | Hu | |
| 3,383,044 | A | | 5/1968 | Norstrud et al. | |
| 3,748,678 | A | | 7/1973 | Ballou | |
| 3,786,869 | A | | 1/1974 | McLoughlin | |
| 3,974,879 | A | | 8/1976 | Nelson et al. | |
| 4,084,281 | A | | 4/1978 | Smith | |
| 4,089,079 | A | | 5/1978 | Nicholson | |
| 4,097,196 | A | * | 6/1978 | Habiger | 417/222.1 |
| 4,135,860 | A | | 1/1979 | van Nederkassel | |
| 4,170,440 | A | * | 10/1979 | Gusmer et al. | 417/426 |
| 4,174,191 | A | * | 11/1979 | Roberts | 417/222.1 |
| 4,207,640 | A | | 6/1980 | Sekula et al. | |
| 4,227,862 | A | | 10/1980 | Andrew et al. | |
| 4,238,074 | A | | 12/1980 | Coons | |
| 4,249,282 | A | | 2/1981 | Little | |
| 4,373,444 | A | | 2/1983 | Cunnington | |
| 4,381,647 | A | * | 5/1983 | Ruseff | 60/452 |
| 4,387,850 | A | | 6/1983 | Gerber | |
| 4,417,826 | A | | 11/1983 | Floros | |
| 4,461,052 | A | | 7/1984 | Mostul | |
| 4,507,053 | A | | 3/1985 | Frizzell | |
| 4,513,466 | A | | 4/1985 | Keddie et al. | |
| 4,532,666 | A | | 8/1985 | Smyth | |
| 4,586,874 | A | * | 5/1986 | Hiraga et al. | 417/222.2 |
| 4,763,373 | A | | 8/1988 | Sanchez | |
| 4,856,133 | A | | 8/1989 | Sanchez | |
| 5,007,127 | A | | 4/1991 | Paolo | |
| 5,029,758 | A | | 7/1991 | Chayer | |
| 5,129,121 | A | | 7/1992 | Gelman | |
| 5,238,191 | A | | 8/1993 | Gaymon | |
| 5,395,052 | A | | 3/1995 | Schneider et al. | |
| 5,421,520 | A | | 6/1995 | Simonette et al. | |
| 5,529,460 | A | | 6/1996 | Eihusen et al. | |
| 5,619,766 | A | | 4/1997 | Zhadanov et al. | |
| 5,649,334 | A | | 7/1997 | Henriquez et al. | |
| 5,741,124 | A | | 4/1998 | Mazzucato et al. | |
| 5,911,256 | A | | 6/1999 | Tsai | |
| 5,913,982 | A | | 6/1999 | Phillips | |
| 5,975,423 | A | | 11/1999 | Rice et al. | |
| 6,021,539 | A | | 2/2000 | Zhadanov et al. | |
| 6,164,496 | A | | 12/2000 | Gregory | |
| 6,189,811 | B1 | | 2/2001 | Rudy | |
| 6,524,079 | B1 | * | 2/2003 | Kimura et al. | 417/269 |
| 6,561,481 | B1 | | 5/2003 | Filonczuk | |
| 6,571,805 | B2 | | 6/2003 | Hoenisch et al. | |
| 6,651,900 | B1 | | 11/2003 | Yoshida | |
| 6,687,924 | B2 | | 2/2004 | Wright et al. | |
| 6,688,855 | B2 | | 2/2004 | Beckerman | |
| 6,857,444 | B2 | | 2/2005 | Davis | |
| 6,913,221 | B2 | | 7/2005 | Moon et al. | |
| 6,915,541 | B2 | | 7/2005 | Alexander | |
| 6,921,060 | B2 | | 7/2005 | Weed | |
| 6,977,013 | B2 | | 12/2005 | Schroeder et al. | |
| 7,017,603 | B1 | | 3/2006 | Rosine et al. | |
| 7,080,953 | B2 | | 7/2006 | DeLaine | |
| 7,083,120 | B2 | | 8/2006 | Gilpatrick et al. | |
| 7,217,053 | B2 | | 5/2007 | Alexander et al. | |
| 7,222,644 | B2 | | 5/2007 | Pianetto et al. | |
| 7,281,903 | B2 | | 10/2007 | Reverberi et al. | |
| 7,316,368 | B2 | | 1/2008 | Moon et al. | |
| 7,389,949 | B2 | | 6/2008 | Marchand et al. | |
| 7,472,842 | B2 | | 1/2009 | Gilpatrick et al. | |
| 7,762,787 | B2 | | 7/2010 | Kawakami et al. | |
| 2004/0131473 | A1 | | 7/2004 | Lanfredi et al. | |
| 2004/0144246 | A1 | * | 7/2004 | Koelzer et al. | 92/71 |
| 2004/0231723 | A1 | | 11/2004 | Harrington et al. | |
| 2005/0013708 | A1 | | 1/2005 | Peeler et al. | |
| 2005/0017117 | A1 | | 1/2005 | Moon et al. | |
| 2005/0161538 | A1 | | 7/2005 | Cattaneo et al. | |
| 2005/0164554 | A1 | | 7/2005 | Cattaneo et al. | |
| 2006/0045752 | A1 | | 3/2006 | Beckman | |
| 2006/0083634 | A1 | | 4/2006 | Dexter et al. | |
| 2006/0110265 | A1 | | 5/2006 | Lanfredi et al. | |
| 2006/0245941 | A1 | | 11/2006 | Sharp | |
| 2007/0113368 | A1 | | 5/2007 | Alexander | |
| 2007/0114319 | A1 | | 5/2007 | Anderson et al. | |
| 2007/0125878 | A1 | | 6/2007 | Hahn et al. | |
| 2007/0267063 | A1 | | 11/2007 | Davis | |
| 2008/0014096 | A1 | | 1/2008 | Gilpatrick | |
| 2008/0050246 | A1 | | 2/2008 | Bevington | |
| 2008/0083077 | A1 | | 4/2008 | Alexander et al. | |
| 2008/0223951 | A1 | | 9/2008 | Tracey et al. | |
| 2008/0245425 | A1 | | 10/2008 | Alexander | |
| 2008/0300727 | A1 | | 12/2008 | Zarowny et al. | |
| 2009/0116972 | A1 | * | 5/2009 | Gilpatrick et al. | 417/234 |
| 2009/0269218 | A1 | | 10/2009 | Gardner et al. | |
| 2010/0243086 | A1 | | 9/2010 | Gilpatrick | |
| 2011/0005024 | A1 | | 1/2011 | Spitler et al. | |
| 2012/0006431 | A1 | | 1/2012 | Gilpatrick | |

OTHER PUBLICATIONS

Energy Tips—Pumping Systems, Pumping Systems Tip Sheet #12, Control Strategies for Centrifugal Pumps with Variable Flow Rate Requirements, U.S. Department of Energy, dated May 2007, 2 pages.

Garden Hose Centrifugal Pump I BIC Superstore, Flint Walling/Star HPP360 Garden Hose Centrifugal Pump, printed on Jan. 6, 2009, from Internet address: http://www.bicsuperstore.com/Garden-Hose-Centrifugal-Pump/M/B000DZKZ02.htm, 3 pages.

Garden Hose Comfort Grip Nozzle 7 Pattern #594 by Gilmour Manufacturing at HardwareandTools.com, Garden Hose Nozzles Zinc "Select-A-Spray", printed on Jan. 6, 2009, from Internet address: http://www.hardwareandtools.com/invt/3774379, 4 pages.

Gauges, Water Pumps, and Flow Meters from Premium Water Filters, Premium Water Filters, printed on Jan. 6, 2009, from Internet address: http://www.premium-water-filters.com/gauges-pumps.htm, 12 pages.

Non-Final Office Action on U.S. Appl. No. 13/399,931, mail date Oct. 16, 2014, 11 pages.

* cited by examiner

WATER PUMP HAVING TWO OPERATING CONDITIONS

CROSS-REFERENCE TO RELATED PATENT APPLICATIONS

This application is a continuation-in-part of U.S. patent application Ser. No. 13/399,931, filed Feb. 17, 2012, which is incorporated herein by reference in its entirety.

BACKGROUND

The present invention relates generally to a device that pressurizes and sprays water, such as for outdoor cleaning applications. More specifically, the present invention relates to a device that is configured to condition the flow of water, such as by changing the flow rate, the water pressure, the shape of the flow exiting the device, or other characteristics of the flow, in order to customize performance of the device to one of a variety of outdoor cleaning tasks.

Different water spraying devices are used for different applications. Garden hose sprayers may be attached to garden hoses and typically include nozzles that constrict the flow path of water in order to condition the flow for various applications, such as cleaning windows, washing a car, watering plants, etc. Flow rate and water pressure are limited by the water source supplying water to the garden hose sprayer, which may be insufficient for some applications.

Pressure washers typically include pumps to increase the pressure of water for heavy-duty cleaning and resurfacing applications. The water pressure is greatly increased relative to typical garden hose sprayer, but the flow rate may be decreased and the intensity of the spray may be too great from some applications, such as cleaning windows and watering plants.

Garden hose booster systems may increase the flow rate was well as water pressure relative to the household water supply, such as for cleaning and other general outdoor tasks. However the water pressure increase by the garden hose booster is typically less than that of a pressure washer. A need exists for a water spraying device configured for a wide variety of outdoor cleaning applications.

SUMMARY

One embodiment of the invention relates to a water pump for use with a prime mover having a power takeoff that rotates about an axis of PTO rotation where the water pump is operable at two operating conditions. The water pump includes a base, a cam, a joint, and a piston. The base includes a PTO-attachment portion, a cam-attachment portion, a first contact surface, and a second contact surface where the PTO-attachment portion is configured to be coupled to a power takeoff for rotation about an axis of PTO rotation and the PTO-attachment portion is positioned opposite the cam-attachment portion. The cam includes a central opening, a first cam contact surface, and a second cam contact surface, wherein the cam-attachment portion of the base extends into the central opening. The joint pivotally couples the cam to the cam-attachment portion of the base so that the cam is pivotable relative to the base about an axis of cam rotation perpendicular to the axis of PTO rotation. The piston is for pumping water and engages the bearing surface. In a first operating position of the cam, corresponding to a first operating condition of the water pump, the first contact surface engages the first cam contact surface so that the cam is positioned at a first angle relative to the axis of PTO rotation. In a second operating position of the cam, corresponding to a second operating condition of the water pump, the second contact surface engages the second cam contact surface so that the cam is positioned at a second angle, greater than the first angle, relative to the axis of PTO rotation.

Another embodiment of the invention relates to a water pump for use with a prime mover having a power takeoff that rotates about an axis of PTO rotation and operable at two operating conditions. The water pump including a base, a cam, a bearing, a joint, and a piston. The base includes a PTO-attachment portion, a base plate, and a cam-attachment portion, wherein the PTO-attachment portion is configured to be coupled to a power takeoff for rotation about an axis of PTO rotation, the base plate is positioned between the PTO-attachment portion and the cam-attachment portion, and the cam-attachment portion includes a first contact surface spaced a first perpendicular distance from the axis of PTO rotation and a second contact surface spaced a second perpendicular distance, different than the first perpendicular distance, from the axis of PTO rotation. The cam includes a cam plate, a central opening, a first cam contact surface, and a second cam contact surface, wherein the cam-attachment portion of the base extends into the central opening. The bearing includes a bearing surface and is coupled to the cam plate. The joint pivotally couples the cam to the cam-attachment portion of the base so that the cam is pivotable relative to the base about an axis of cam rotation perpendicular to the axis of PTO rotation. The piston is for pumping water and engages the bearing surface. In a first operating position of the cam, corresponding to a first operating condition of the water pump, the first contact surface engages the first cam contact surface so that the bearing surface is positioned at a first angle relative to the axis of PTO rotation. In a second operating position of the cam, corresponding to a second operating condition of the water pump, the second contact surface engages the second cam contact surface so that the bearing surface is positioned at a second angle, greater than the first angle, relative to the axis of PTO rotation.

Another embodiment of the invention relates to a water pump for use with a prime mover having a power takeoff that rotates about an axis of PTO rotation and operable at two operating conditions. The water pump includes a base, a cam, a bearing, a joint, and a piston. The base includes a PTO-attachment portion and a cam-attachment portion, where the PTO-attachment portion is configured to be coupled to a power takeoff for rotation about an axis of PTO rotation, the PTO-attachment portion is positioned opposite the cam-attachment portion, and the cam-attachment portion includes a first contact surface and a second contact surface. The cam includes a first cam contact surface and a second cam contact surface where the first cam surface is not parallel to the second cam surface. The bearing includes a bearing surface and is coupled to the cam. The joint pivotally couples the cam to the cam-attachment portion of the base so that the cam is pivotable relative to the base about an axis of cam rotation perpendicular to the axis of PTO rotation. The piston is for pumping water and engages the bearing surface. In a first operating position of the cam, corresponding to a first operating condition of the water pump, the first contact surface engages the first cam contact surface thereby preventing further rotation of the cam in a first direction about the axis of cam rotation and positioning the bearing surface at a first angle relative to the axis of PTO rotation. In a second operating position of the cam, corresponding to a second operating condition of the water pump, the second contact surface engages the second cam contact surface thereby preventing further rotation of the cam in a second direction, opposite the first direction, about the axis of cam rotation and positioning the bearing surface at a second angle, greater than the first angle, relative to the axis of PTO rotation.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
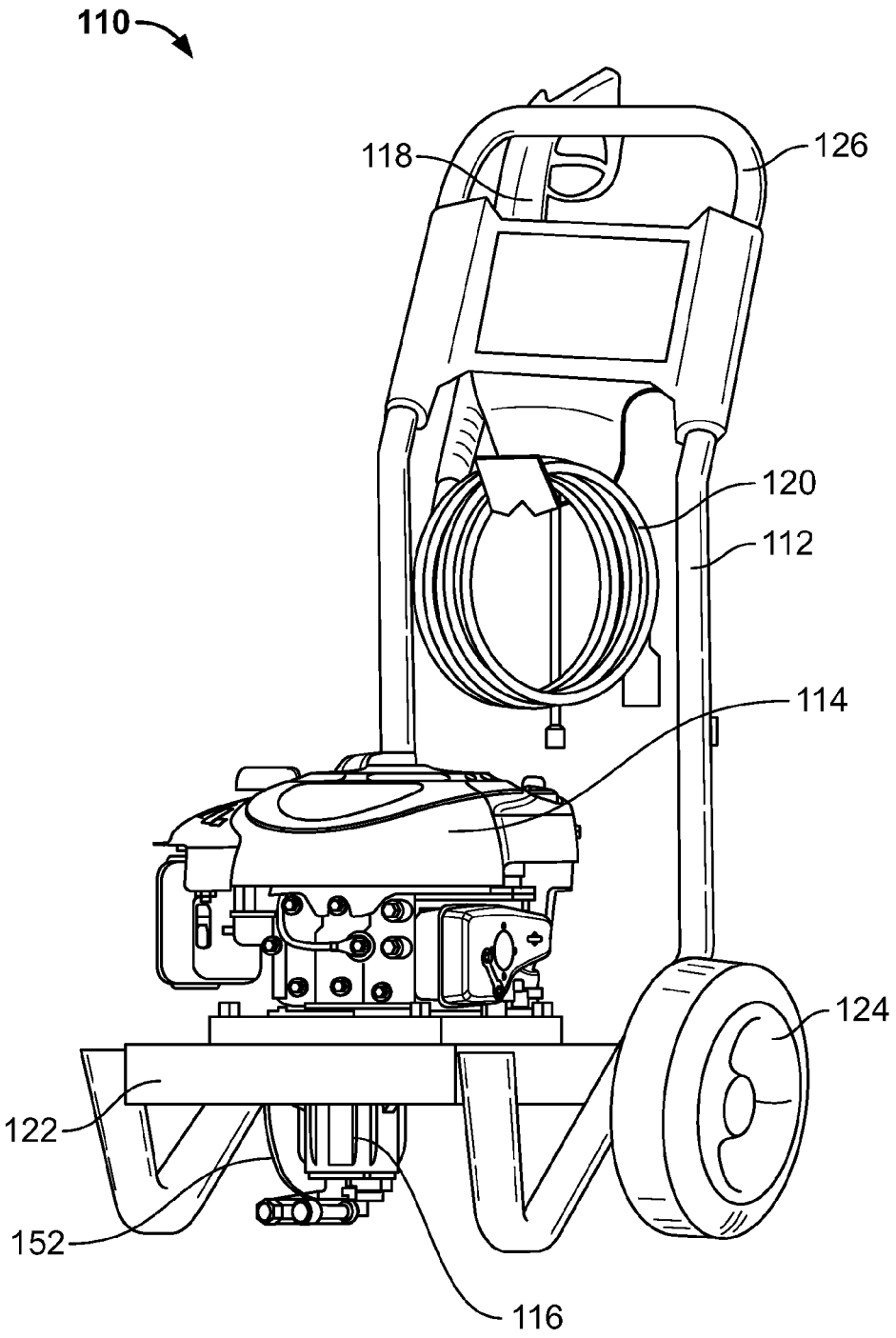
FIG. 1 is perspective view of a water spraying device, according to an exemplary embodiment.

Referring to FIG. 1, a water spraying device 110 includes a frame 112 supporting a prime mover such as an engine 114 and a water pump 116 (e.g., positive displacement pump, piston water pump, axial cam pump) configured to be connected to a spray gun 118 with a hose 120. According to an exemplary embodiment, the engine speed is controlled by a stepped motor coupled to the engine governor. In some embodiments, the engine 114 is fastened to the top of a base plate 122 of the frame 112 and the water pump 116 is mounted below the base plate 122 and connected to a power takeoff of the engine 114 via a hole through the base plate 122 (not shown). In some embodiments, the water spraying device 110 is portable and includes wheels 124 and a handle 126. In other embodiments, an electric motor is used in place of the engine and the water spraying device may be stationary. According to one exemplary embodiment, the water pump may be powered by an electric motor with a power output of between 0.25 and 10 horsepower. In some embodiments, the electric motor may be an AC motor operated from an electrical power source between 120VAC and 440VAC at between 50 Hz and 60 Hz. In other embodiments, the electric motor may be an DC motor operated from an electrical power source between 12 V and 48 V. The motor speed is controlled by a speed controller (e.g., a speed control circuit).

Figure 2:
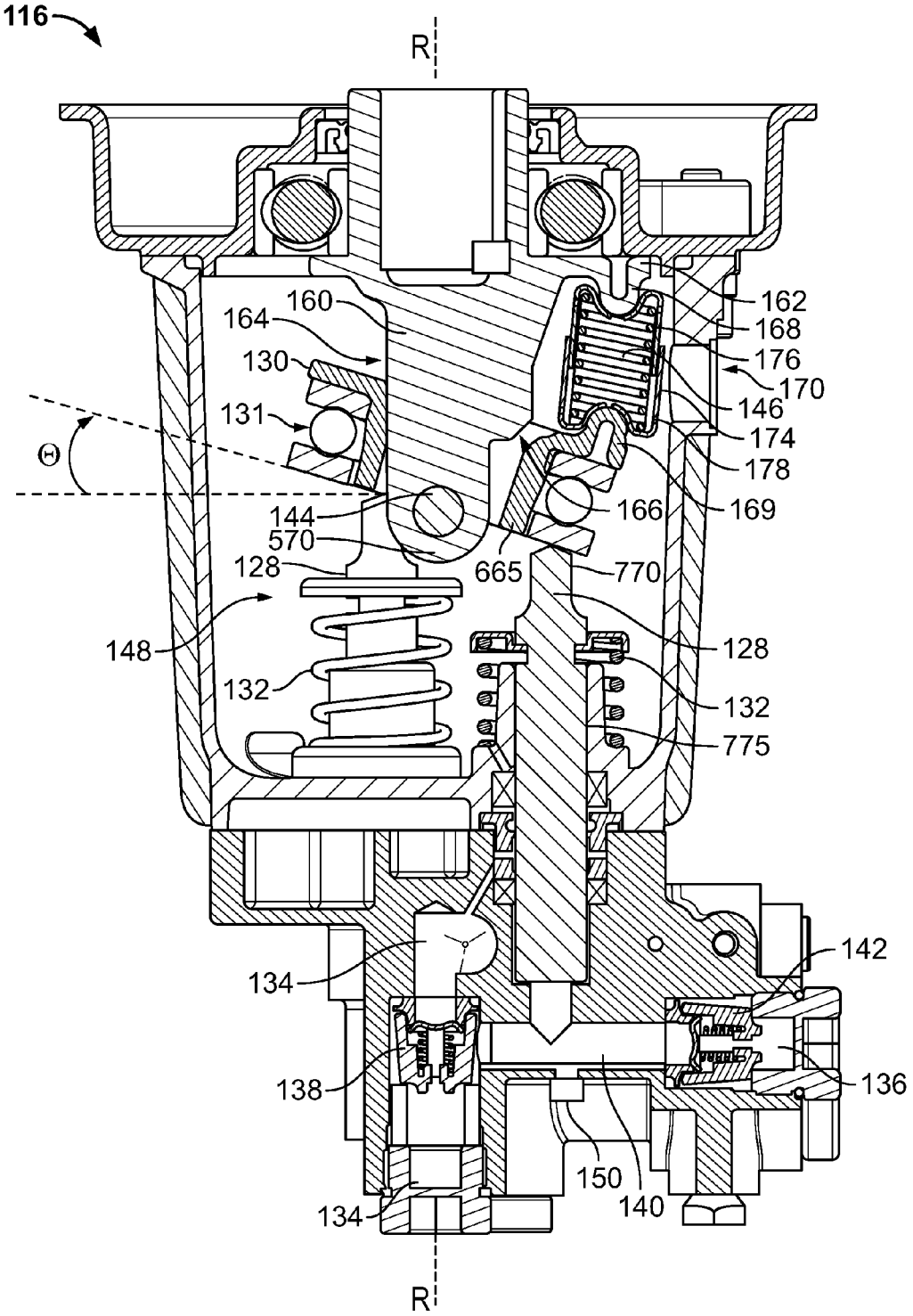
FIG. 2 is a sectional view of a water pump, according to an exemplary embodiment.

Referring to FIG. 2, the water pump 116 is shown as having an interior chamber 148 containing pistons 128 and a cam 130 (e.g., wobble plate, swashplate, etc.) configured to be connected with the power takeoff of the engine 114. Because the cam 130 is connected to the power takeoff of the engine 114, the pump speed (e.g., cam RPM) is a function of the engine speed. According to an exemplary embodiment, the water pump 116 includes three pistons 128 arranged symmetrically about the axis of rotation R of the cam 130. A face of the cam 130 is angled and contacts the piston 128. The cam 130 may include a bearing device 131 to reduce friction losses between the cam 130 and the pistons 128. The piston 128 is biased to a first position with a spring 132, and as the cam 130 rotates, the slanted face of the cam 130 overcomes the bias and drives the piston (e.g., piston 128) to pump water. Movement of the piston 128 draws water from an inlet 134 through a first check valve 138 and into a pumping chamber 140, then pushes the water through a second check valve 142 to an outlet 136 (e.g., manifold) of the water pump 116. The flow rate of the pump 116 is related to (e.g., proportional to) the rate of rotation of the cam 130 and the stroke length of the piston 128. The stroke length of the piston 128 (e.g., from top dead center to bottom dead center) is related to the slant angle θ of the face of the cam 130. According to an exemplary embodiment, the cam 130 pivots relative to a base or holder 160 about a central joint 144. The central joint 144 allows the cam 130 to rotate about an axis orthogonal to the axis of rotation R of the cam 130 (and the power takeoff).

Figure 3:
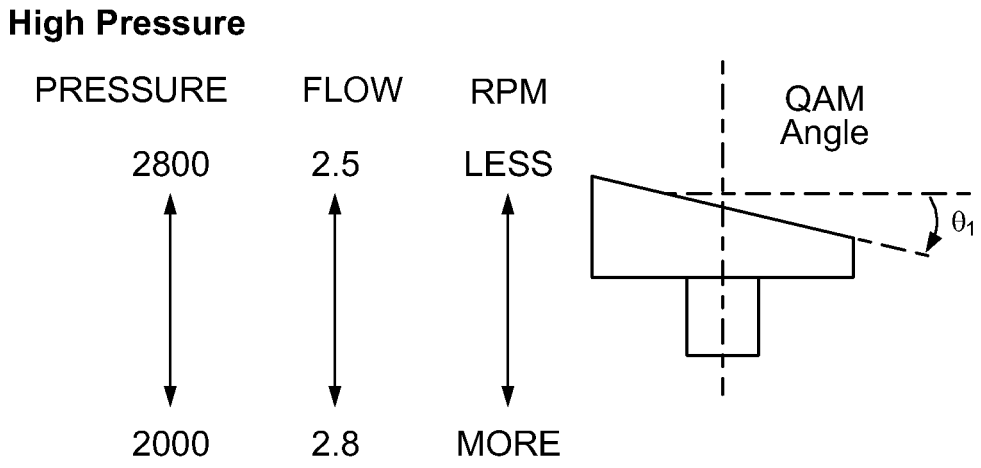
FIGS. 3-4 are schematic diagrams associating a slant angle of a cam of water pump with characteristics of a resulting water flow, according to an exemplary embodiment.
Figure 4:
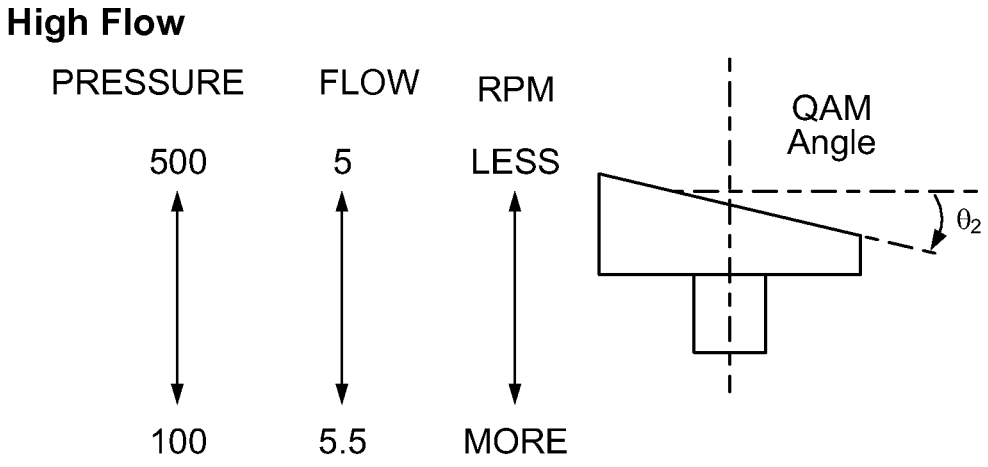

Referring to FIGS. 3-4, hypothetical flow characteristics are provided as a function of slant angle θ of the cam 130. At a first slant angle $\theta_1$, the engine-powered water pump provides output at a pressure of 2000 to 2800 pounds per square inch (psi) and a flow rate of 2.5 to 2.8 gallons per minute (gpm), where variation within the ranges may be at least partially controlled by engine speed (i.e., revolutions per minute). At a second slant angle $\theta_2$, the water pump provides output at a pressure of 100 to 500 psi and a flow rate of 5 to 5.5 gpm. Accordingly, the first slant angle $\theta_1$ may be better suited for higher pressure applications, while the second slant angle $\theta_2$ may be better suited for higher flow rate applications.

Figure 5:
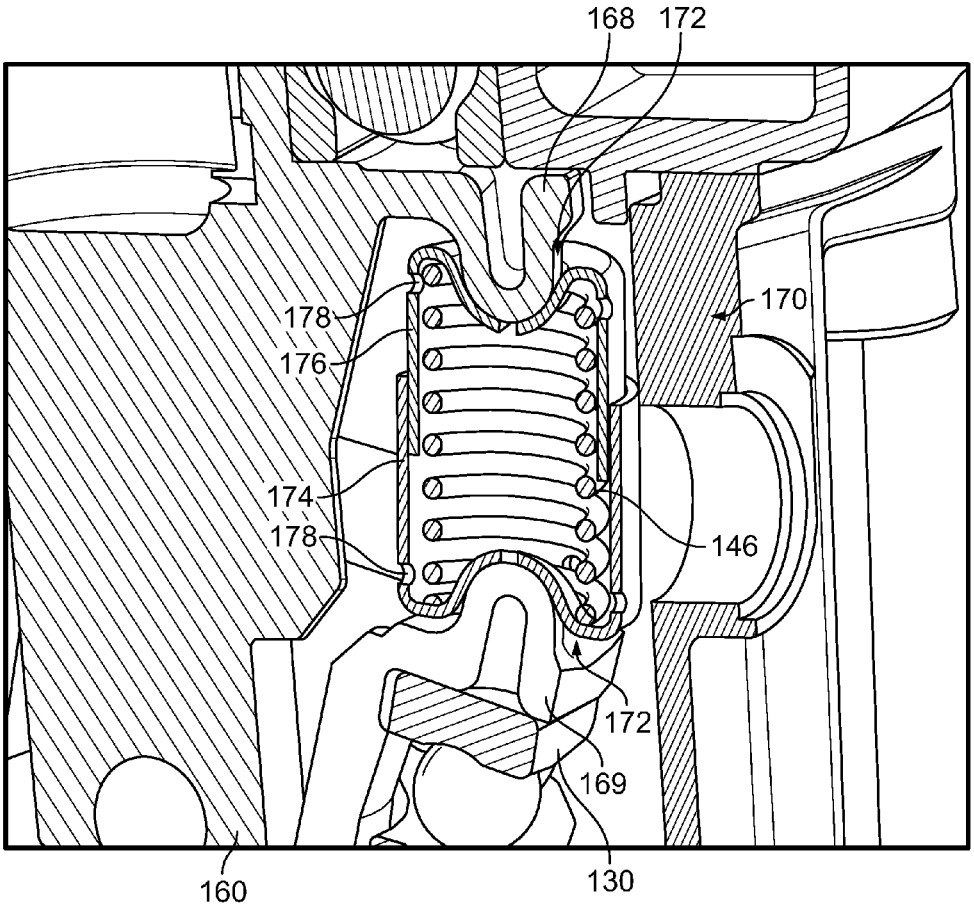
FIG. 5 is an isometric sectional view of a portion of the water pump of FIG. 2.

Referring to FIGS. 2 and 5, the cam 130 is biased towards the steeper, first slant angle by a spring 146 that is compressed between the cam 130 and an upper flange 162 of the holder 160. The spring 146 is contained within a telescoping enclosure 170 (e.g., holder, container, cup, casing, etc.). The enclosure 170 prevents the spring 146 from deforming due to centripetal forces as the cam 130 rotates. The cam 130 is prevented from exceeding the first slant angle by a first contact surface 164 of the holder 160. The cam 130 is prevented from exceeding the second slant angle (and flattening out, resulting in zero displacement of the pistons 128) by a second contact surface 166 of the holder 160.

The enclosure 170 is rotatably and pivotally coupled to the holder 160 and to the cam 130 via projections 168 and 169, respectively. The projections 168 and 169 are received in hollows 172 on either end of the enclosure 170. The enclosure 170 includes a first cup-shaped portion 174 and a second cup-shaped portion 176. The first portion 174 has a diameter that is larger than the diameter of the second portion 176, allowing the second portion 176 to nest within the first portion 174. The first portion 174 may therefore slide relative to the second portion 176, providing the enclosure 170 with a variable interior volume that can adjust with the length of the spring 146 as the cam 130 moves from the first slant angle to the second slant angle. The interior of the enclosure 170 may be filled with oil. As the interior volume of the enclosure 170 increases or decreases in response to the extension or compression of the spring 146, oil can be drawn into or expelled from the interior of the enclosure 170 through openings 178 in the first portion 174 or the second portion 176. A thin layer of oil between the overlapping walls of the first portion 174 and the 176 creates a fluid bearing. Further, the flow of the oil in and out of the enclosure 170 may be effective to dampen the oscillations of the spring 146.

Figure 9:
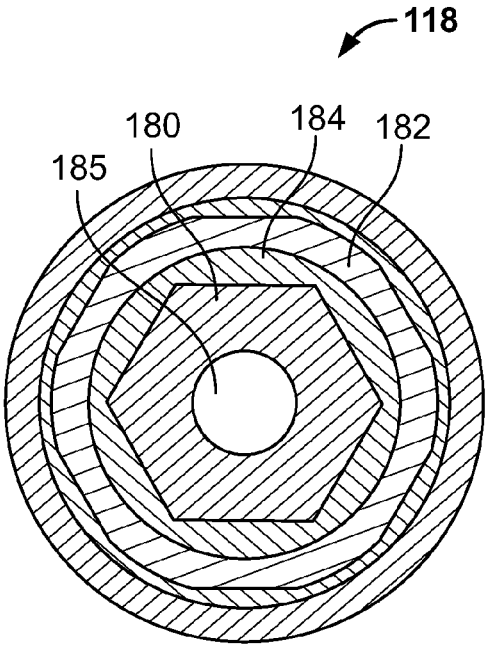
FIG. 9 is a sectional view of the nozzle end of FIG. 8, taken along line 9-9.

Referring to FIGS. 6-9, the nozzle end 119 of the spray gun 118 is shown according to an exemplary embodiment. The nozzle end 119 is coupled to the end of a conduit 121. As shown, the nozzle end 119 may be a relatively simple mechanism including an inner body or base 180 coupled to the end of the hose 120, an outer body or shell 182, and a grip 184. The grip 184 is a tube-like member that is rotationally locked to the base 180. As shown in FIG. 9, the inner surface of the grip 184 and the outer surface of the base 180 may each be polygonal (e.g., hexagonal). Further, coupling members such as spring pins 186 may be provided to further couple together the base 180 and the grip 184. The shell 182 surrounds the base 180 and an end of the grip 184. The shell 182 is rotatable relative to the base 180 and the grip 184. To facilitate the rotation of the shell 182, the outer surfaces of the grip 184 and the shell 182 may include contours or textures (e.g., ribs, fins, angled faces, knurling, nubs, bumps, etc.) to be more easily grasped by a user. According to another exemplary embodiment, the nozzle end 119 may be coupled directly to the hose 120.

The conduit 121 is inserted into the grip 184 and is received in a socket 185 in the base 180. Fluid is directed from the conduit 121 to a nozzle tip 190 through a primary central bore 192 in the base 180. The base 180 further includes one or more secondary bores 194. The secondary bores 194 are in fluid communication with the socket 185 and are arranged in a circular arc around the central bore 192. The shell 182 includes passages 196 that can be selectively aligned with the secondary bores 194 in the base 180. Sealing elements 195 (e.g., o-rings, gaskets, a resilient coating, etc.) may be provided around the outlets of the secondary bores 194 between the base 180 and the shell 182. In a first position, the passages 196 are aligned with the corresponding bores 194 in the base, allowing fluid from the conduit 121 to be output through both the nozzle tip 190 and the passages 196 surrounding the nozzle tip 190 thereby increasing the water output cross-section of the nozzle. The user can close off the passages 196 by rotating the shell 182 relative to the base 180 and the grip 184 until the passages 196 in the shell 182 are no longer aligned with the secondary bores 194 in the base 180 thereby decreasing the water output cross-section of the nozzle. The outlets of the secondary bores 194 are sealed against an inner surface of the shell 182 by the sealing elements 195 and fluid is output only through the nozzle tip 190. An auxiliary passage 198 may be provided in one or more of the components of the spray gun 118 (e.g., the base 180, the shell 182, and/or the grip 184) that is not in fluid communication with the central bore 192, the secondary bores 194, or the passages 196. Instead, the auxiliary passage 198 may be facilitate the delivery of another substance, such as a cleaning compound that may be utilized with the fluid from the conduit 121.

Figure 10:
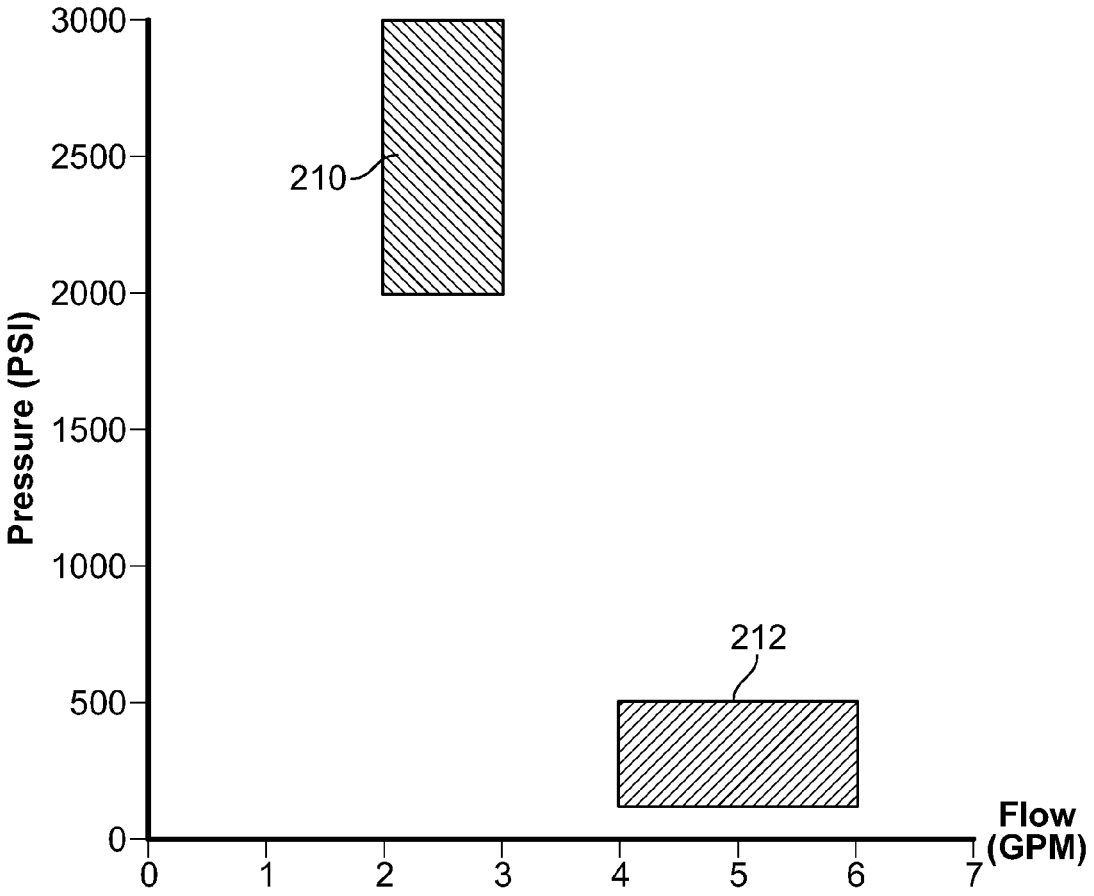
FIG. 10 is a schematic diagram of water pressure and flow rate of three different modes of a water pump, according to an exemplary embodiment.

Referring to FIG. 10, the slant angles $\theta_1$ and $\theta_2$ of the cam 130 correspond to different modes of operation of the engine-driven water pump: a high-pressure, low-flow mode 210 and a low-pressure, high-flow mode 212. The shaded areas 210 and 212 in FIG. 10 provide exemplary zones of operation of the pump in the two modes. While the pressure and flow rate may vary in the zones, the zones do not intersect with one another, as demonstrated in FIG. 10. The angle of the cam 130 is configured to change in response to the back pressure from the nozzle of the spray gun 118. A relatively large outlet nozzle and a relatively small outlet nozzle can be provided by the spray gun 118 as described above. The large nozzle corresponds to the configuration in which fluid is output through both the central nozzle tip 190 and the outer passages 196. The small nozzle corresponds to the configuration in which the outer passages 196 are closed and fluid is output through only the central nozzle tip 190. The small nozzle creates a higher pressure stream and an increased back pressure which results in decreased displacement of the pistons 128 as the cam 130 flattens and moves toward the first slant angle $\theta_1$ driving the pump to operate in zone 210. A minimum slant angle and flow rate are maintained by the contact of the cam 130 and the second contact surface 166. Switching to the large nozzle (e.g., by turning the shell 182) decreases the back pressure resulting in increased displacement of the pistons 128 as the cam 130 is biased toward the second slant angle $\theta_2$ by the spring 146, driving the pump to operate in zone 212. A maximum slant angle and a minimum fluid pressure are maintained by the contact of the cam 130 and the first contact surface 164.

Use of only two modes 210, 212 with only two corresponding slant angles $\theta_1$, $\theta_2$ for an engine-driven water pump is intended to improve the durability and stability of the water pump 116. It is believed that less vibration and wobble of the cam 130 about the central joint 144 and correspondingly less variation in the output of the water pump 116 will occur if the pump 116 is limited to only two modes 210, 212. A reduction in the vibration and wobble of the cam 130 about the central joint 144 also reduces the repeated impact of the cam 130 against the contact surfaces 164 and 166.

In one embodiment, the water spraying device 110 may be changed from an actively spraying condition as described above to an idle or no-spray condition. When an operator releases the trigger 117 on the spray gun 118, a sensor on the gun detects that the trigger 117 is released, such as by closing or opening a circuit as a function of the position of the trigger 117. When the sensor detects that the trigger 117 has been released, the sensor communicates the information to the engine 114 (e.g., by wired or wireless communication to a receiver on the engine or in the engine control module). The release of the trigger 117 may be therefore utilized to change the speed of the engine 318, such as to an idle speed. According to another exemplary embodiment, the sensor may be a pressure sensor that is configured to sense the presence of an operator's hand on the grip 184. According to yet another exemplary embodiment, the pump includes an idle control module that places the engine into an idle speed when the trigger 117 on the spray gun 118 is released without utilizing a sensor or electronic communications.

Referring still to FIG. 10, the water pump may be operated by an electric motor in a third mode of operation 211. The pressure and flow rate of such an electric motor zone of operation 211 may intersect with the engine-driven zones 210 and 212 or may not intersect, as shown in FIG. 10.

Figure 11:
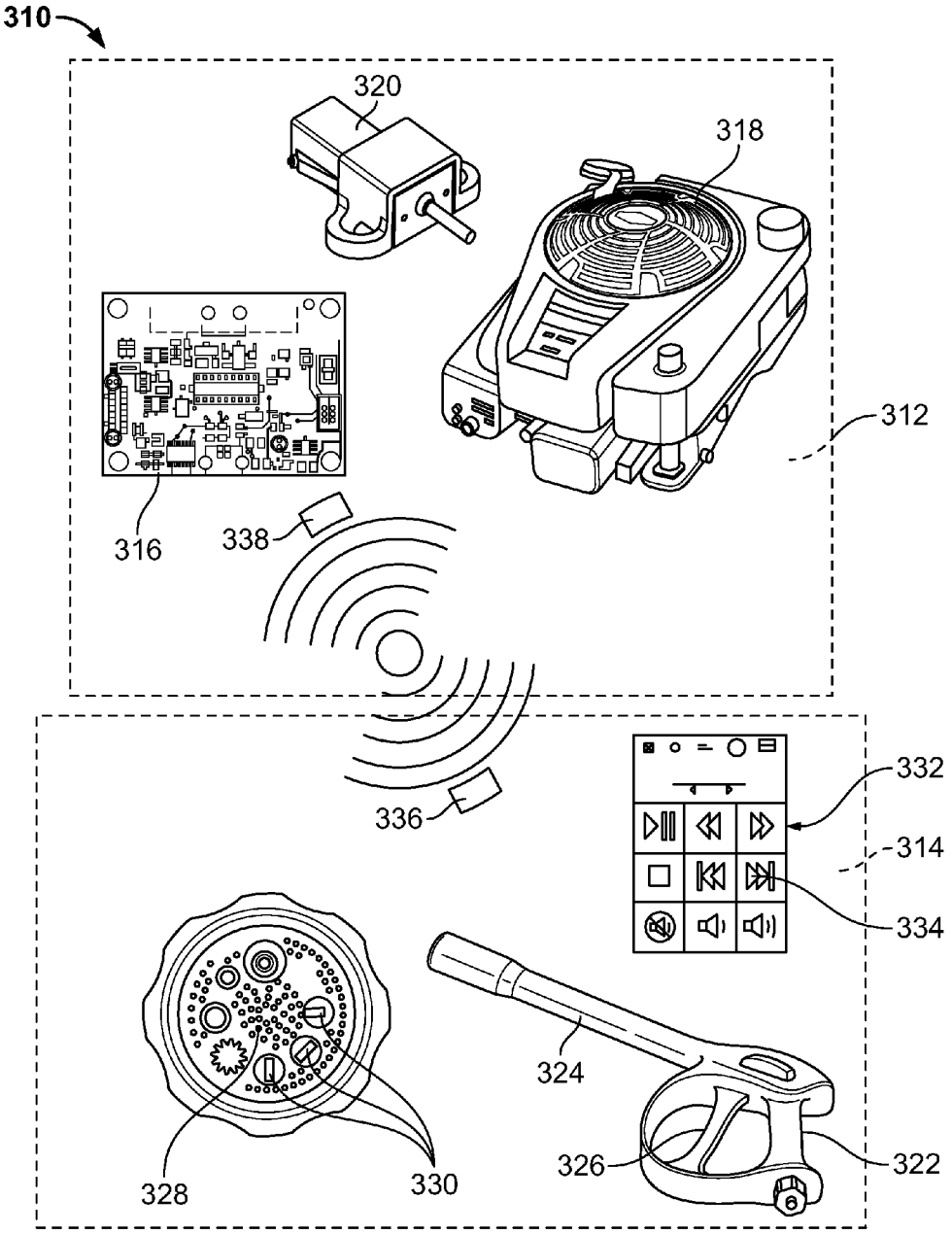
FIG. 11 is a perspective view of components of a water spraying device, according to an exemplary embodiment.

Referring to FIG. 11, according to another exemplary embodiment, a system in the form of a water spraying device 310 includes a pump assembly 312 and a spray gun 314. The pump assembly 312 includes a water pump (see, e.g., water pump 116 as shown in FIG. 1) driven by an engine 318 or another suitable prime mover such as an electric motor. The pump assembly 312 further includes circuitry 316 (e.g., electronic control unit, hardwired circuitry, computer) configured to change the speed of the engine 318. The circuitry 316 is housed in a waterproof or water-resistant compartment integrated with the water pump assembly 312. In some embodiments, the circuitry 316 is integrated with an electronic governor or throttle of the engine 318. In other embodiments, the circuitry 316 is configured to operate an actuator, such as a motor 320 (e.g., stepper motor), which adjusts a mechanical component of a governor or throttle.

Figure 6:
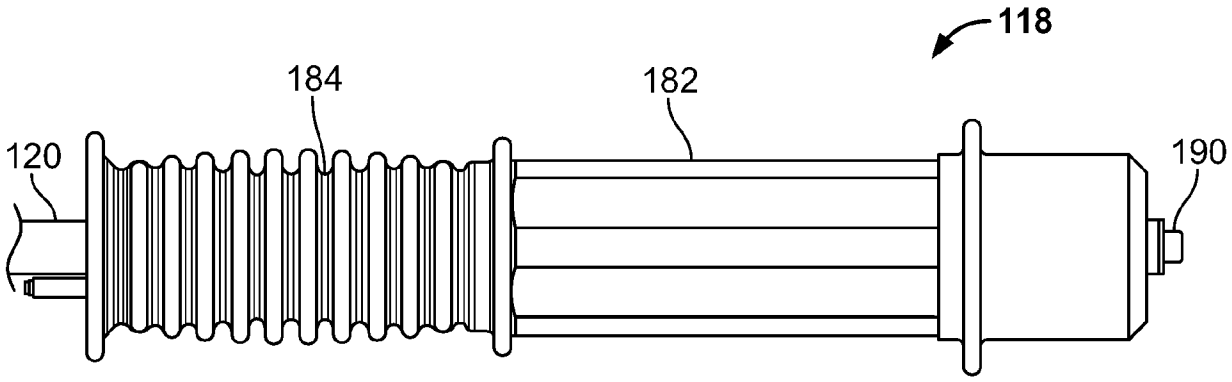
FIG. 6 is a side view of the nozzle end of a spray gun for a water spraying device, according to an exemplary embodiment.
Figure 7:
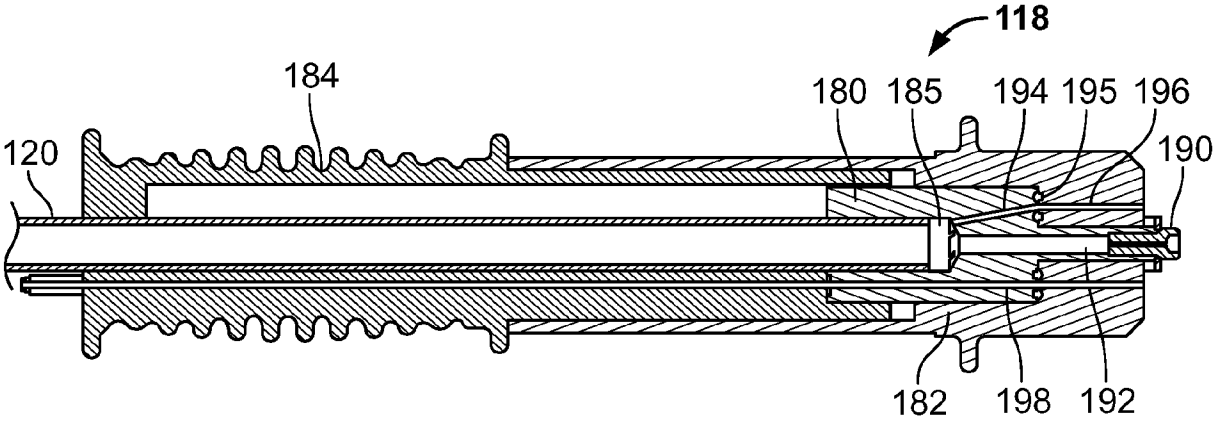
FIG. 7 is a sectional view of the nozzle end of FIG. 6.
Figure 8:
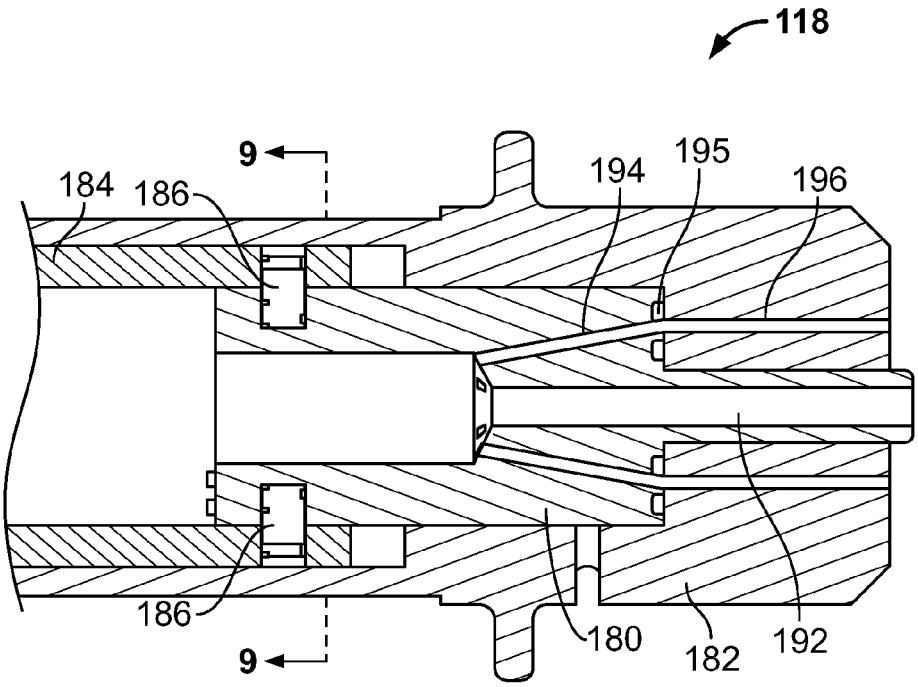
FIG. 8 is a sectional view of the nozzle end of a spray gun for a water spraying device, according to an exemplary embodiment.
Figure 12:
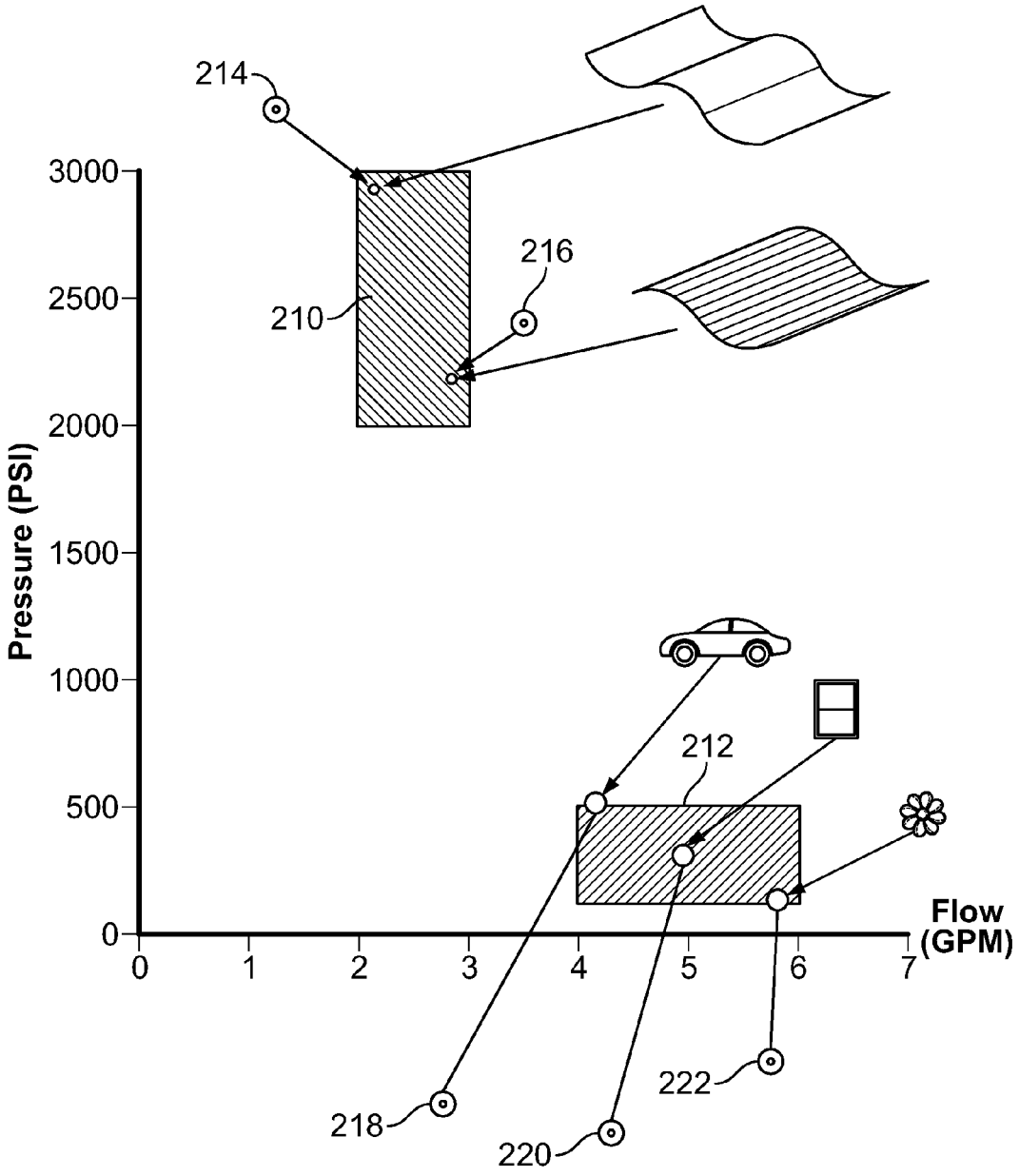
FIG. 12 is a schematic diagram of water pressure and flow rate of three different modes of a water pump, according to an exemplary embodiment.

According to an exemplary embodiment, water pump 116 may include a cam 130 that is pivoted relative to the holder 160 about the central joint 144 by an actuator (e.g., linear actuator, solenoid, rack and pinion, hydraulic cylinder, etc.). According to an exemplary embodiment, the actuator is coupled to (e.g., connected with, in communication with, controlled by, operated with) circuitry (see generally circuitry 316 as shown in FIG. 6), which is configured to operate the actuator to change the slant angle θ of the cam 130. The actuator may be operated, for example, by circuitry 316. The actuator is configured to change the slant angle θ of the cam 130 to either of two slant angles (see generally FIGS. 3-4), which correspond to different modes of operation of the water pump: a high-pressure, low-flow mode 210 and a low-pressure, high-flow mode 212. Use of only two modes 210, 212 with only two corresponding slant angles $\theta_1$, $\theta_2$ allows the actuator to be rigidly constrained in extended and retracted positions, such as by ends of a stroke for an actuator in the form of a hydraulic cylinder, which is intended to improve the durability and stability of the water pump 116. It is believed that less vibration and wobble of the cam 130 about the central joint 144 and correspondingly less variation in the output of the water pump 116 will occur if the actuator is limited to only two modes 210, 212. A reduction in the vibration and wobble of the cam 130 about the central joint 144 also reduces the repeated impact of the cam 130 against the contact surfaces 164 and 166. In other contemplated embodiments, the actuator is configured to change the slant angle θ of the cam 130 to more than two slant angles, such as three, four, or any angle within a bounded range between 0 and 90 degrees (e.g., between 5 and 45 degrees). In an exemplary embodiment, the actuator is configured to change the slant angle θ of the cam 130 to two or more slant angles within a bounded range between 0 and 17 degrees According to an exemplary embodiment, changes in characteristics of the spray may occur when the water pump 116 is in either of the two modes 210, 212 by changing the engine speed and by changing the nozzle orifice of the spray gun 118. As shown in FIG. 12, different nozzle orifices used with the different modes 210, 212 of the pump 116 may be ideal for different cleaning tasks. Operation of the spray device in the first mode 210 with a small orifice 214 may be ideal for cleaning concrete surfaces, while operation with a larger orifice 216 at a slower engine speed may be optimal for home siding. To wash a car, the water pump 116 may be operated in the second mode 212 with a relatively small orifice 218 compared to the orifice 220 used to wash windows, which may in turn be smaller than the orifice 222 used to water plants. Accordingly, in some settings the water pump 116 may be used to increase the flow rate for watering of flowers and other delicate applications. In other settings, the water pump 116 may be used to increase water pressure relative to the household water supply to strip paint, remove mold, or otherwise clean tough surfaces. As such, the water pump 116 and spray gun 118 may be used to for a broad range of outdoor applications that would otherwise require multiple water spraying devices, such as a pressure washer and a garden hose booster system.

According to the exemplary embodiment shown in FIG. 12, the two modes 210, 212 are distinct such that the flow rates and pressures of the two modes do not intersect, and a non-operation band, both with respect to flow and pressure, exists between the modes 210, 212. In this embodiment, the engine-driven water spraying device, operates at a pressure equal to or above 2000 psi (mode 210) or equal to or below 500 psi (mode 212) and at a flow rate equal to or below 3 gpm (mode 210) or equal to or above 5 gpm (mode 212). The pressure ranges and flow ranges of modes 210 and 212 may be altered in other embodiments (e.g., above 1000 psi or below 300 psi and below 2 gpm or above 1 gpm). Even though the water spraying device does not operate in certain flow and pressure bands/regions, the two modes 210, 212 of operation are suitable for many common types of cleaning, and therefore the water spraying device need not be configured to operate in the non-operation band. This configuration may permit a simplified machine design because fewer modes are required.

Referring still to FIG. 12, the water pump may be operated by an electric motor in a third mode of operation 211. The pressure and flow rate of such an electric motor zone of operation 211 may intersect with the engine-driven zones 210 and 212 or may not intersect, as shown in FIG. 10. According to an exemplary embodiment, changes in characteristics of the spray may occur when the water pump 116 is in the electric motor-driven modes 211 by changing the motor speed and by changing the nozzle orifice of the spray gun 118. As shown in FIG. 12, different nozzle orifices used with the mode 211 may be ideal for different cleaning tasks. Operation of the spray device in the mode 211 with a small orifice 215 may be ideal for cleaning concrete surfaces, while operation with a larger orifice 217 at a slower engine speed may be optimal for home siding.

According to an exemplary embodiment, the spray gun 314 includes a handle 322, a barrel 324 (e.g., shaft), and a trigger 326. In some embodiments, the spray gun 314 includes a head 328 on a distal end of the barrel 324. The head 328 may include a variable outlet to change the structure through which the water flows when spraying from the spray gun 314. In some embodiments, the head 328 includes a variety of nozzle orifices 330 that may be rotated into and out of an active position that is aligned with a flow path through the head 328. Some of the orifices 330 may have larger openings (i.e., a larger water output cross-section) than others. Some of the orifice 330 may have circular openings, while others have flat slots or are otherwise shaped. Some of the orifices 330 may include an array of small openings (e.g., patterned pin holes).

According to an exemplary embodiment, the spray gun 314 includes an interface 332 configured to receive input from an operator of the spray gun 314, and communicate the input to the water pump assembly 312 for control of the water pump. The interface 332 may include buttons, a dial, levers, a touch screen, or other features that allow the operator to provide input. In some embodiments, the interface 332 further includes an electronic display 334 (e.g., computerized display, screen). The electronic display 334 may include information associated with the water of the spray gun 314, such as the flow rate, the water pressure, the nozzle orifice shape, the cumulative amount of water used, the duration of spraying, etc.

In some embodiments, the spray gun 314 further includes a motor (see generally motor 320) or other actuator that rotates the head 328 of the spray gun 314 to change which particular nozzle orifice 330 is active. The motor 320 may be a throttle stepper motor. The operator may select a setting of the water spraying device 310 via the interface 332 of the spray gun 314, and circuitry (see generally circuitry 316) may direct the motor to rotate the head 328 accordingly. In some embodiments, the interface 332 of the spray gun 314 is integrated with the barrel 324 or the handle 322. In other contemplated embodiments, the interface 332 of the spray gun 314 is integrated with the head 328, where rotation of the head 328 is sensed and a corresponding signal is communicated to the water pump assembly 312 to change the mode of operation of the water pump as a function of rotating the head 328 or the particular nozzle orifice 330 positioned in the active position.

Inputs provided by the operator of the hand gun 314 may be communicated to the circuitry 316 of the water pump assembly 312, to change operation of the pump (see, e.g., pump 116 as shown in FIG. 1) and engine 318. In some embodiments, input is communicated to the water pump assembly 312 via a wired connection, such as a wire coupled to a hose (see, e.g., hose 120 as shown in FIG. 1) connected between the spray gun 314 and the water pump assembly 312. In other embodiments, the input is communicated wirelessly to the water pump assembly 312, where the spray gun 314 includes a transmitter 336 (e.g., transceiver, radio-frequency source) and the water pump assembly 318 includes a receiver 338 (e.g., transceiver, radio-frequency sensor). According to other embodiments, the communication between the spray gun 314 and the water pump assembly 318 may be two-way communication.

In some embodiments, communications from the spray gun 314 are received by the circuitry 316 of the pump assembly 312, which then changes the mode 210, 212 of the water pump by changing the slant angle θ of the cam with the actuator (see FIG. 2). In some embodiments, communications from the spray gun 314 are received by the circuitry 316 of the pump assembly 312, which then changes the speed of the engine 318 by changing the throttle setting with the motor 320. In other embodiments, communications from the spray gun 314 change the engine speed by changing the target speed or target range of the electronic governor, without the motor 320. In other embodiments, the pump assembly may not be a variable pump assembly. Instead, the mode 210, 212 of the water spraying device 310 may be accomplished with only adjustments to the nozzle orifice 330 and the speed of the engine 318 (e.g., via electronic communication between the nozzle and the engine).

Figure 13:
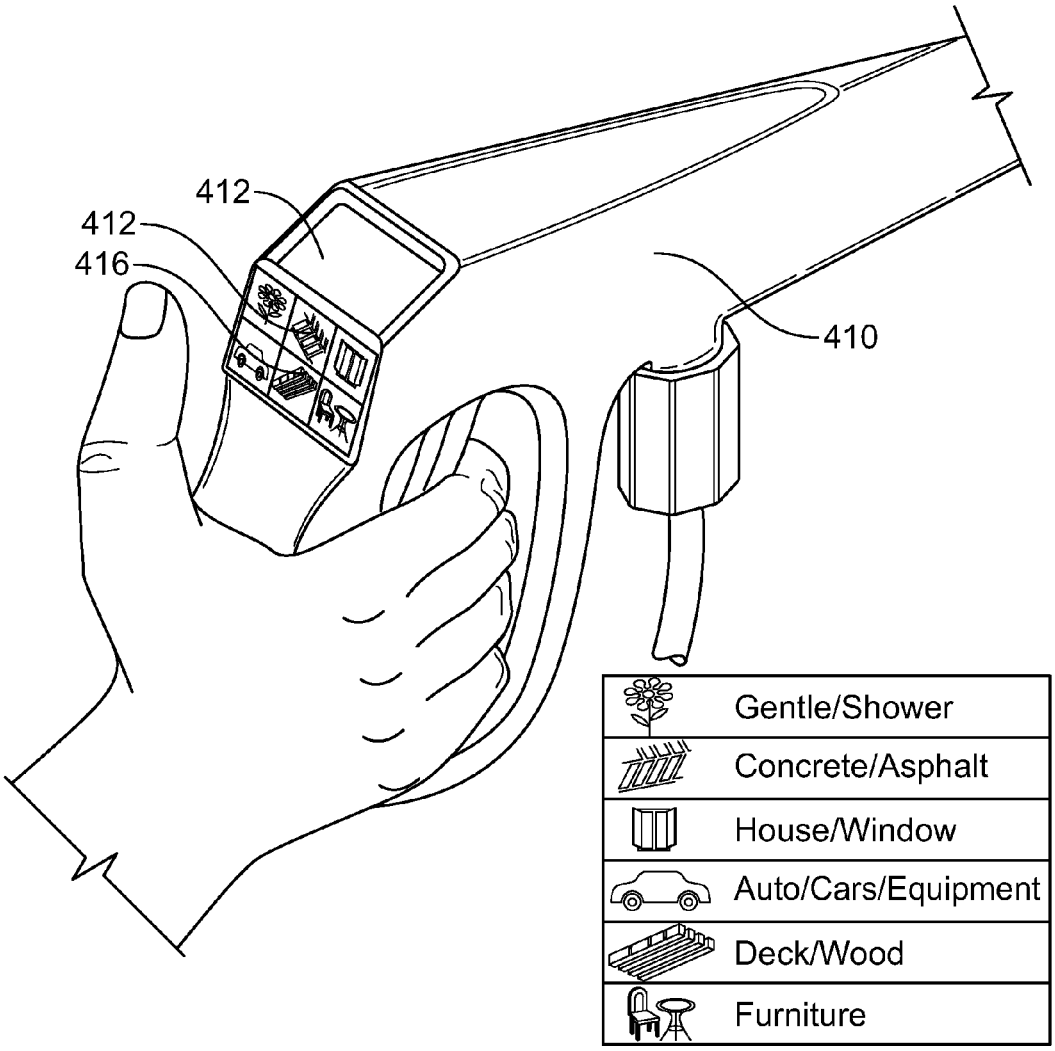
FIG. 13 is a perspective view of a spray gun, according to an exemplary embodiment.

Referring to FIG. 13, in some embodiments, a spray gun 410 includes an electronic display 412 and a touch screen 414. The electronic display 412 and touch screen 414 are coupled to circuitry integrated with the spray gun 410 (see generally circuitry 316 as shown in FIG. 6) configured to provide an array of icons 416 on the display 412, such as icons corresponding to different settings of the water spraying device.

In some embodiments, each of the icons 416 corresponds to a unique flow condition provided by the water spraying device. The unique flow condition may differ from flow conditions associated with other icons 416 with regard to one or more attributes of the flow provided by the spray gun 410, such as water pressure, flow velocity, spray shape due to nozzle orifice geometry, flow rate, flow dithering (i.e., oscillating in pressure, velocity, flow rate, direction), inclusion of chemicals (e.g., detergent), turbulence (e.g., laminar versus turbulent flow), and other attributes.

Figure 14:
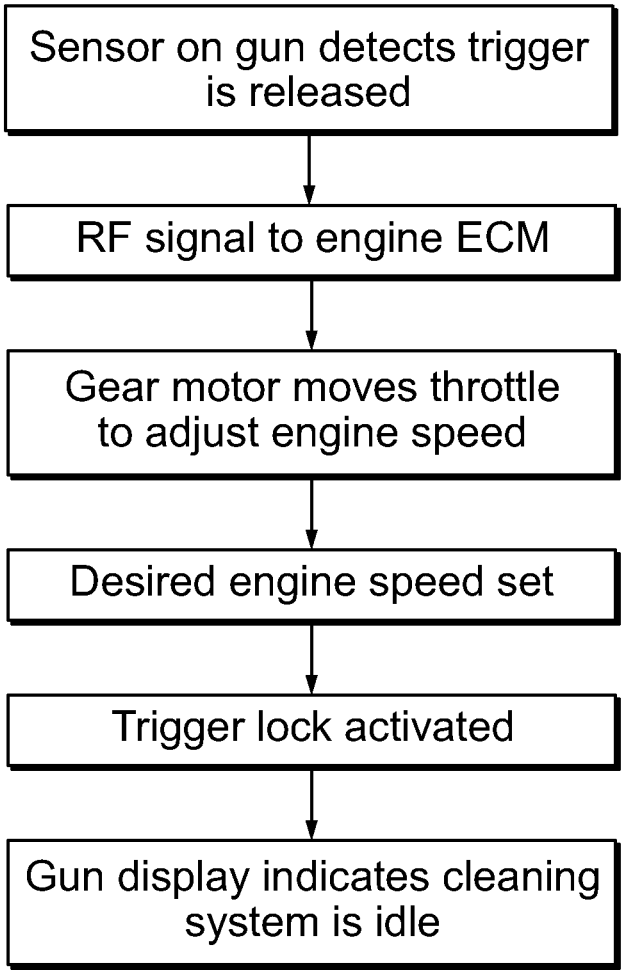
FIG. 14 is a flow chart including steps for changing a mode of operation of a water spraying device, according to an exemplary embodiment.
Figure 15:
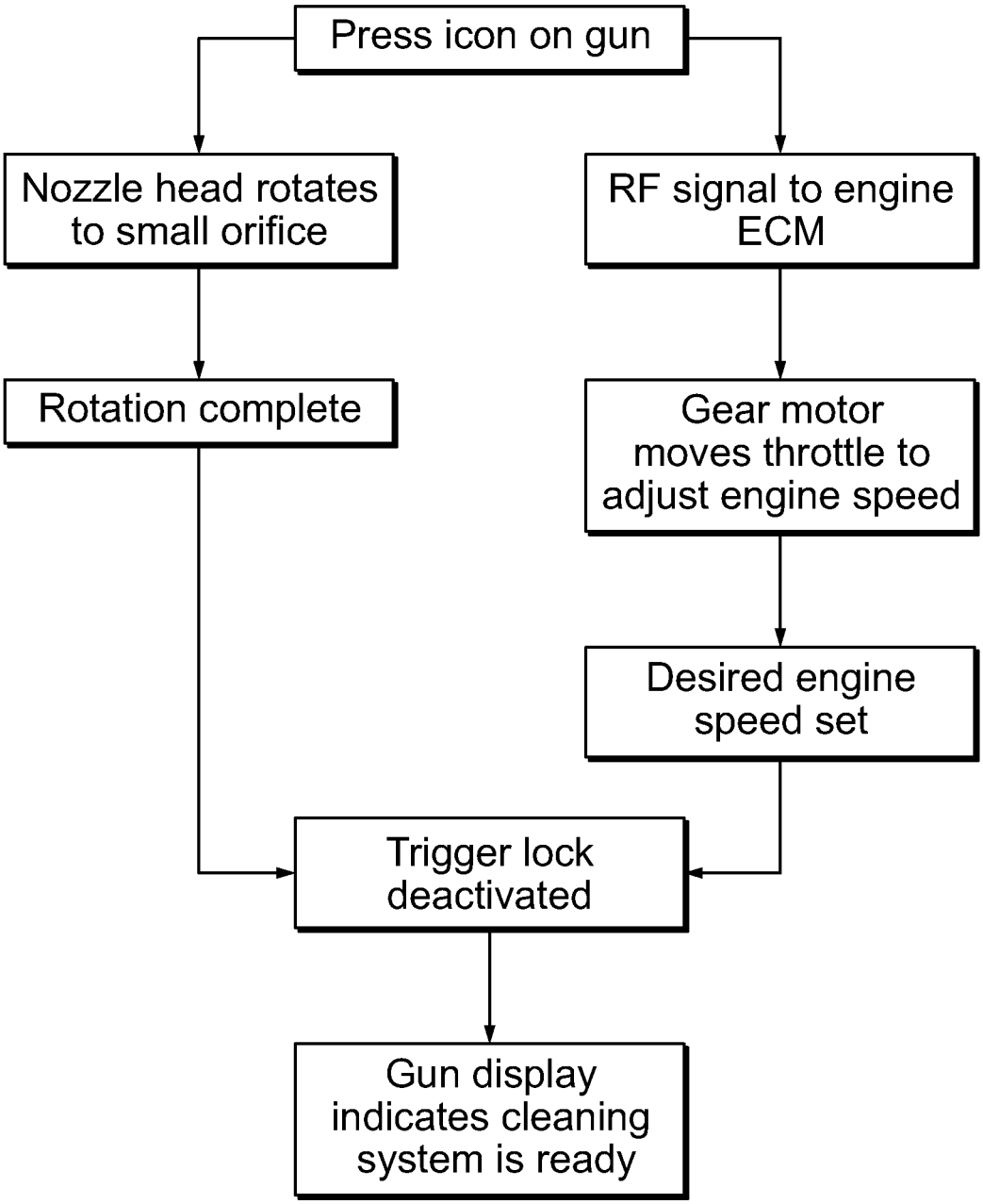
FIG. 15 is a flow chart including steps for changing another mode of operation of a water spraying device, according to an exemplary embodiment.

Referring to FIGS. 11 and 14, a method for operating a water spraying device includes changing the setting of the water spraying device 310 (FIG. 11) from actively spraying to an idle or no-spray condition. When an operator releases the trigger 326 on the spray gun 314, a sensor on the gun detects that the trigger 316 is released, such as by closing or opening a circuit as a function of the position of the trigger 326. When the sensor detects that the trigger 326 has been released, the sensor communicates the information to the circuitry of the spray gun 314, which provides associated information to the transmitter 336. A radio-frequency signal is provided by the transmitter 336 on the spray gun 314 to the circuitry 316 coupled to the engine 318 by way of the receiver 338. The motor 320 moves the throttle of the engine 318 to change the speed of the engine 318, such as to an idle speed. Concurrently, a trigger lock (e.g., solenoid driven pin or latch coupled to the control circuitry) in the spray gun 314 interlocks the trigger 326. The electronic display 334 then indicates that the water spraying device 310 is idle or inactive.

Referring to FIGS. 11-13 and 15, a method of operating the water spraying device 310 includes changing the setting of the water spraying device 310 from actively spraying in a first setting to actively spraying in a second setting, or from being idle to actively spraying. Of the variety of different icons 416 (see FIG. 13), the operator selects an icon 416 on the touch screen 414 of the spray gun 410 corresponding to a particular setting. Upon selecting of the icon 416, a motor (see generally motor 320 as shown in FIG. 11) integrated with the spray gun 314 (FIG. 11) rotates the head 328 of the spray gun 314 to a corresponding nozzle orifice 330. Concurrently, the spray gun 314 communicates a wireless signal to the circuitry 316 of the water pump assembly 312 (e.g., electronic engine control module). The motor 320 that is coupled to the throttle of the engine 318 changes the engine speed, or the electronic control module changes the target speed of the governor. When the desired speed of the engine 318 is achieved and the head 328 of the spray gun 314 is rotated to the appropriate nozzle orifice 330, the lock on the trigger 326 is released and the electronic display 334 indicates that the spray gun 314 is ready for operation.

Referring once more to FIGS. 1-2, in some contemplated embodiments, a pressure sensor 150 (FIG. 2) is connected to the water pump 116 and provides (wired, wireless, mechanical (e.g., Bowden cable 152 in FIG. 1)) feedback to the electronic control module or throttle of the engine 114. When the water pump 116 is in recirculation, such as when the throttle is released and trapped pressure opens an unloader valve (not shown) of the water pump 116, then the pressure sensor 150 communicates instructions to idle the engine 114.

When the trigger is pulled, water sprays from the spray gun 118, the unloader valve closes and the resulting change in pressure is sensed and communicated by the pressure sensor 150 to the engine 114, to return the engine 114 to operational speed.

In contemplated embodiments, the circuitry 316 water spraying device 310 is configured to interface with outside computers, such as via a wired or wireless connection. The operator may download new icons and flow settings for the water spraying device 310. An online database may include a large library of different icons and associated spraying options that are particularly tailored to nuanced applications, such as cleaning clay from the treads of a particular type of tire or watering a particular type of rose bush. In some embodiments, an operator or other person may develop their own customized settings for the water spraying device 310 that may be communicated directly to the water spraying device 310 and added to the online database. In contemplated embodiments, a water spraying device 310 (e.g., spray gun or water pump assembly) may include a seat or compartment to support a smart phone or other portable computer that includes various spray settings and control options.

Referring again to FIGS. 2 and 16-18 the base 160, the cam 130, the joint 144, the telescoping enclosure 170, and the spring 146 (FIGS. 17 and 18), hereinafter collectively referred to as the cam assembly 500, are illustrated. The cam 130 is pivotally coupled to the base 160 by the joint or pin 144, and a biasing member 505 formed by the spring 146 and the telescoping enclosure 170 biases the cam 130 relative to the base 160. The base 160 includes a PTO-attachment portion 510, a flange or plate 162, and a cam-attachment portion 515. The plate 162 is positioned between the PTO-attachment portion 510 and the cam-attachment portion 515.

Figure 17:
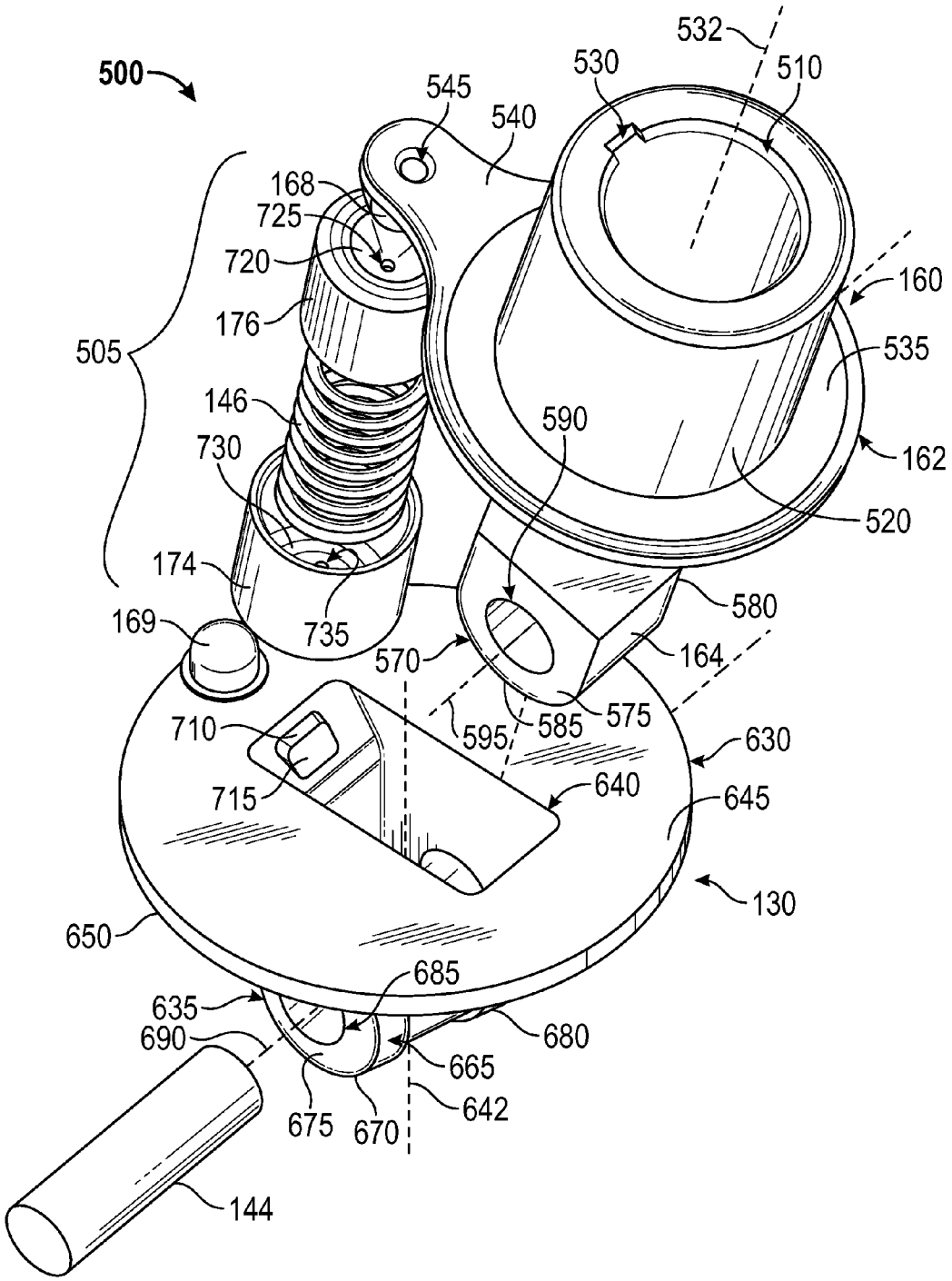
FIG. 17 is an exploded perspective view of the cam assembly of FIG. 16.
Figure 18:
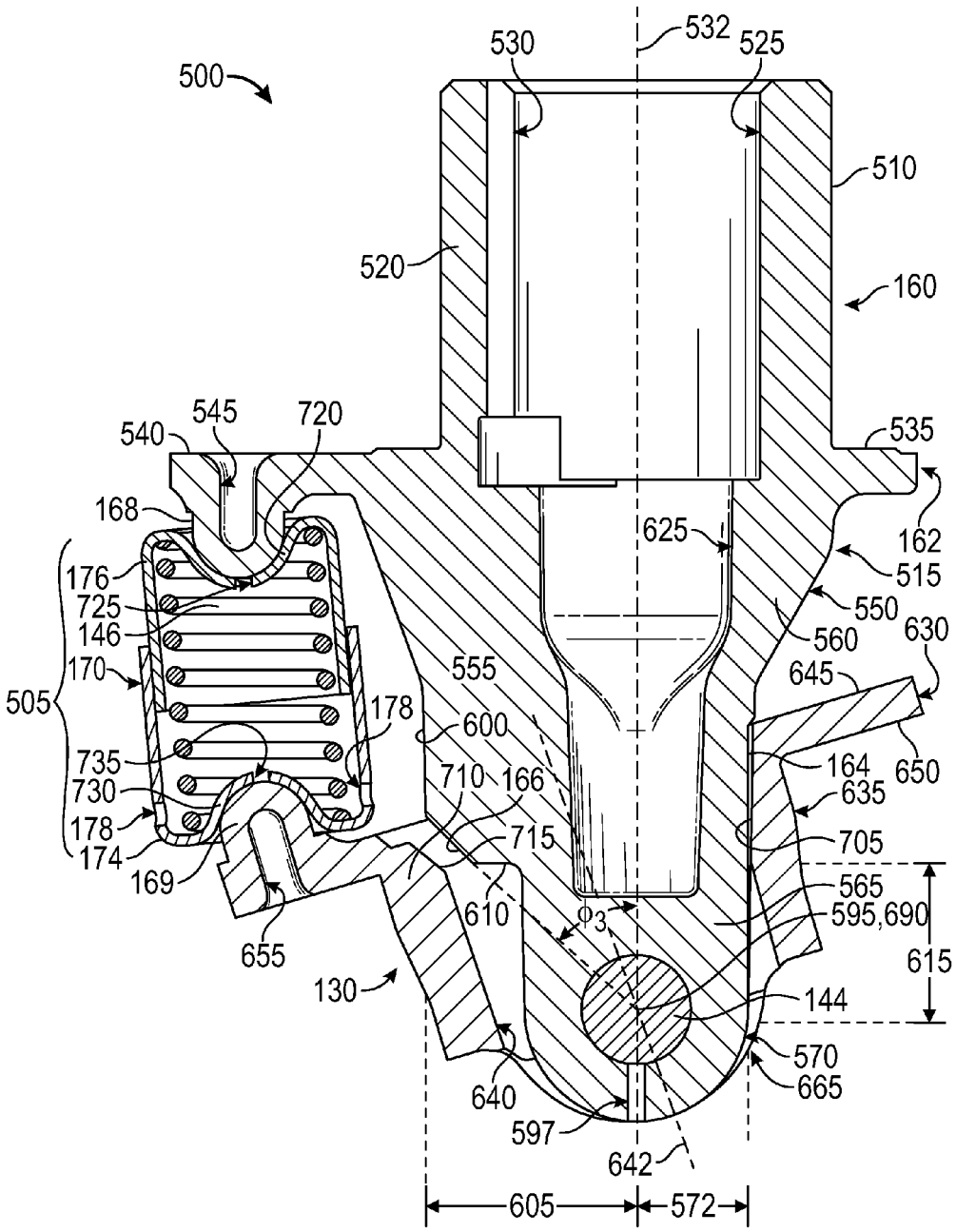
FIG. 18 is a sectional view of the cam assembly of FIG. 16.

The PTO-attachment portion 510 includes a cylindrical body 520 with a central opening 525 (see FIG. 18) and a keyway 530. The central opening 525 is configured to receive the power takeoff ("PTO") of a prime mover (e.g., the engine 114 or an electric motor). The keyway 530 allows the PTO of the prime mover to be secured to the base 160 with a keyed connection so that the base 160 rotates with the PTO of the prime mover about an axis of PTO rotation 532 (FIGS. 17-18). Alternatively, the PTO of the prime mover includes a keyway and the PTO-attachment portion 510 does not.

Referring to FIGS. 17-18, the plate 162 includes a circular body 535 and an arm 540 extending therefrom. The arm 540 extends radially outward from the axis of PTO rotation 532. The arm 540 includes a coupling projection or ball 168 that extends from the lower surface (i.e., same side as the cam-attachment portion 515) of the arm 540. A material-saving void 545 extends from the upper surface (i.e., same side as the PTO-attachment portion 510) of the arm 540 into the ball 168 so that wall thickness of the plate 162 stays relatively constant. This relatively constant wall thickness helps in the die casting of the base 160. Alternatively, the void 545 is not included.

Figure 16:
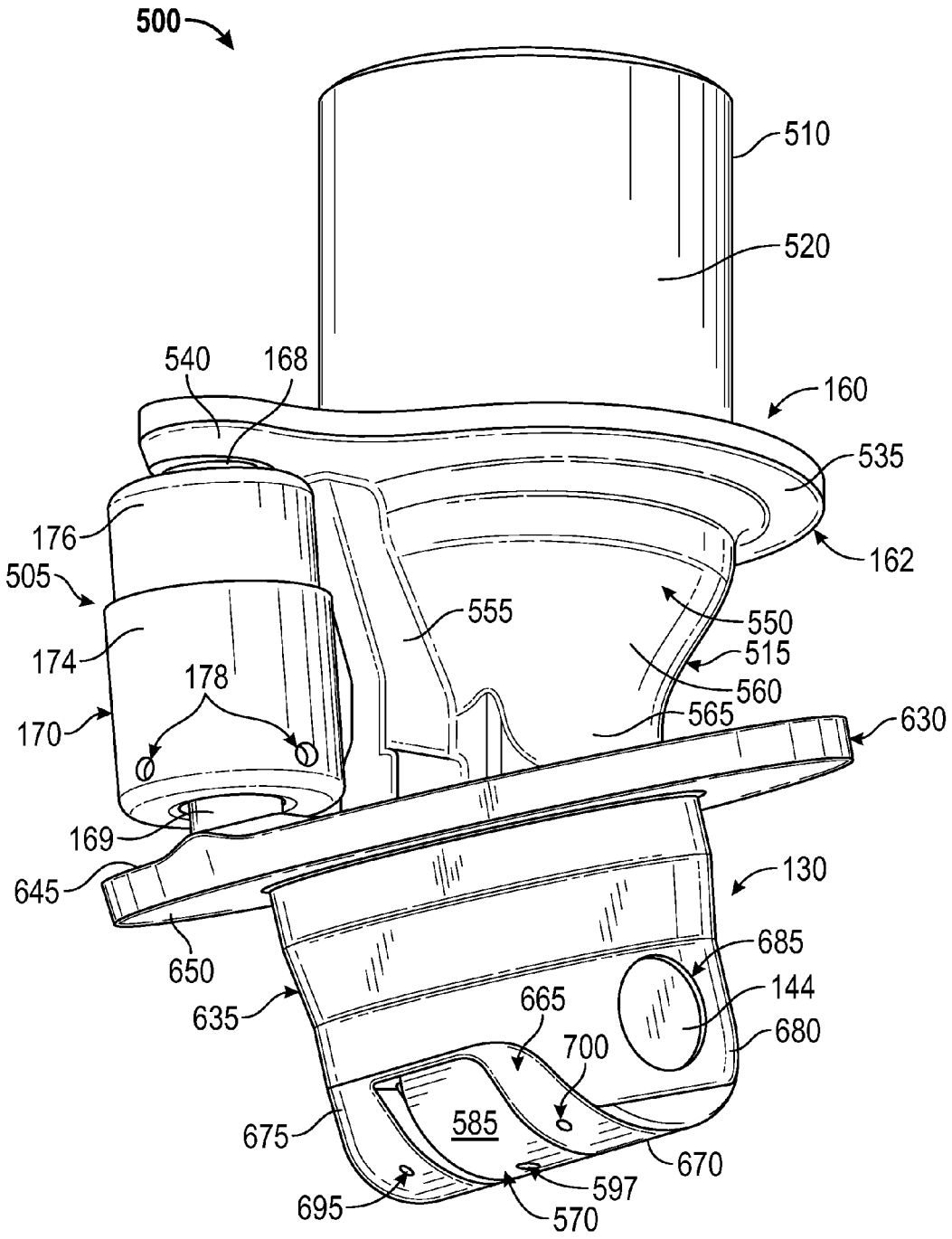
FIG. 16 is a front perspective view of a cam assembly for a water pump, according to an exemplary embodiment.

Referring further to FIGS. 16-18, the cam-attachment portion 515 extends from the lower surface of the plate 162 and includes a central body 550 and a web or shoulder 555 that extends radially outwardly from the central body 550. The central body 550 includes a tapered base 560 adjacent the plate 162 and a protrusion 565 that extends from the base 560 to a tip 570. A portion of the outer surface of the protrusion 565 forms the first contact surface 164. The first contact surface 164 is located at a distance 572 from the axis of PTO rotation 532 and is substantially parallel to the axis of PTO rotation 532. The tip 570 includes two flat sides 575 and 580 (FIG. 17) arranged opposite from one another and a curved bottom surface 585 (FIG. 18) that extends between the two flat sides 575 and 580. As shown in FIGS. 17-18, a circular through-hole 590 extends from the first flat side 575 to the second flat side 580 and is centered on an axis of cam rotation 595 (FIG. 18). The axis of cam rotation 595 is perpendicular to the axis of PTO rotation 532. The through-hole 590 is sized and shaped to receive the pin 144. In an exemplary embodiment, a bushing is positioned in the through-hole 590 and coupled to the base 160 and the bushing is sized and shaped to receive the pin 144. Alternatively, multiple bushings are used. The bushing or bushings can be made of brass or other suitable materials. A lubricant passageway 597 is formed between the bottom surface 585 and the through-hole 590 to provide lubricant to the through-hole 590. The lubricant passageway 597 is centered on the axis of PTO rotation 532. Alternatively, the tip 570 includes more or fewer lubricant passageways.

Referring to FIG. 18, the shoulder 555 is located opposite the first contact surface 164. The shoulder 555 includes a substantially vertical outer surface 600 that is located at a distance 605 from the axis of PTO rotation 532, a substantially horizontal lower surface 610 that is located at a distance 615 from the axis of cam rotation 595, and the second contact surface 166 which extends between the outer surface 600 and the lower surface 610 at an angle $\theta_3$ relative to the axis of PTO rotation 532. When measured in a direction perpendicular to the axis of PTO rotation 532, the entirety of the second contact surface 166 is located further away from the axis of PTO rotation 532 than the entirety of the first contact surface 164. The second contact surface 166 is angled relative to (i.e., not parallel to) the first contact surface 164. In an exemplary embodiment, the shoulder 555 extends radially outward from the axis of PTO rotation 532 in the same direction as the arm 540 such that the arm 540, the first contact surface 164, and the second contact surface 166 are aligned with one another.

Referring to FIG. 18, a material-saving void 625 extends from the central opening 525 into the central body 550 so that the wall thickness of the central body 550 stays relatively constant. This relatively constant wall thickness helps in the die casting of the base 160. Alternatively, the void 625 is not included. In an exemplary embodiment, the base 160 is formed from die-cast aluminum. In other embodiments, other suitable materials and forming techniques can be used.

Referring to FIGS. 16-18, the cam 130 includes a flange or plate 630 and a central protrusion 635 extending from the plate 630. As shown in FIGS. 17-18, a central opening 640 is formed through the plate 630 and the central protrusion 635. The plate 630, the central protrusion 635, and the central opening 640 are centered on a cam axis 642. The plate 630 and the central protrusion 635 have a relatively constant wall thickness that helps in the die casting of the cam 130. In an exemplary embodiment, the cam 130 is formed from die-cast aluminum. In other embodiments, other suitable materials and forming techniques can be used.

Referring to FIGS. 16-18, the plate 630 includes a upper surface 645 and a lower surface 650. A coupling projection or ball 169 extends from the upper surface 645. A material-saving void 655 extends from the lower surface 650 into the ball 169 so that the wall thickness of the plate 630 stays relatively constant to help with die casting the cam 130. Alternatively, the void 655 is not included.

Figure 20:
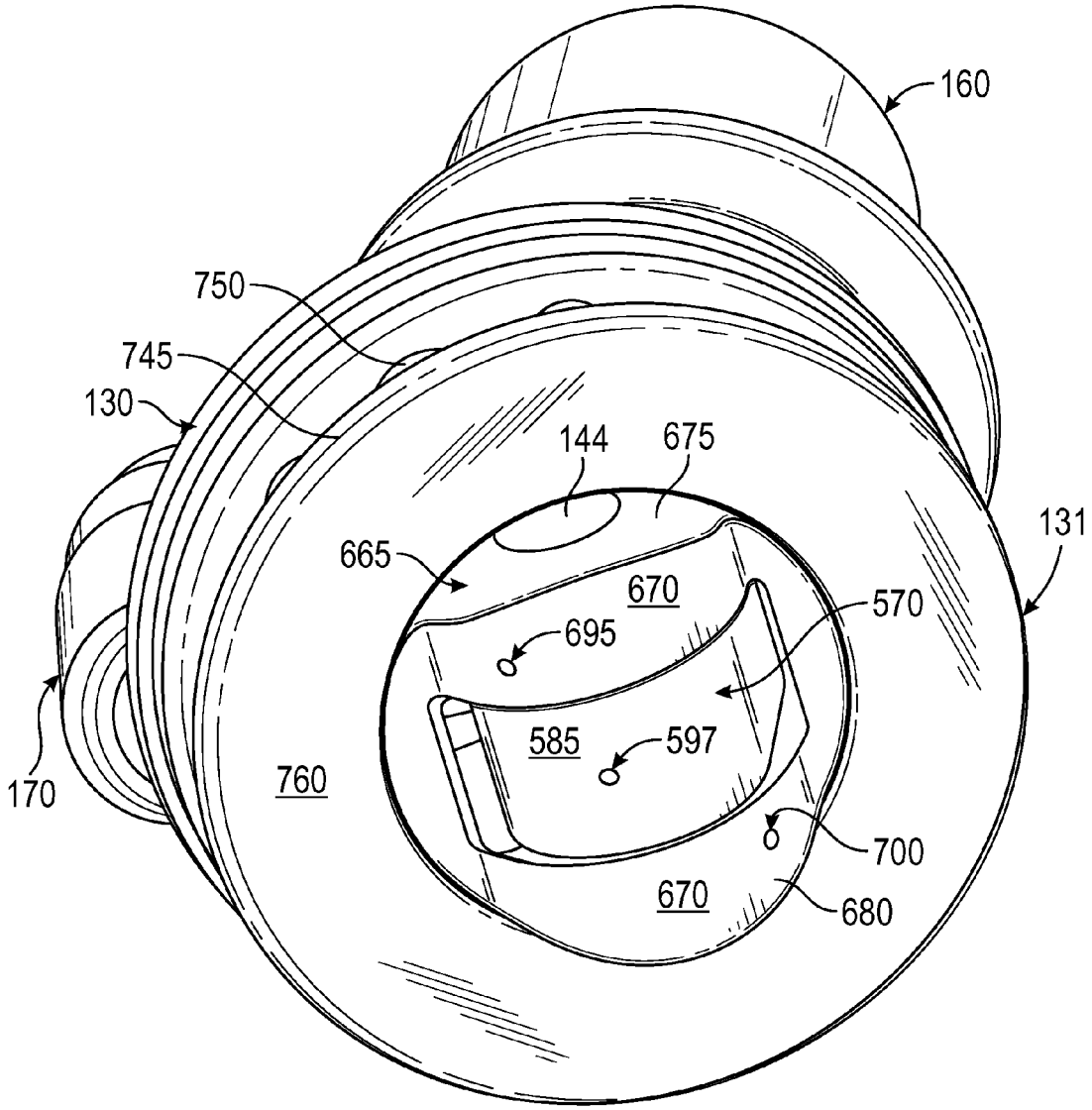
FIG. 20 is a bottom perspective view of a cam and bearing assembly.
Figure 21:
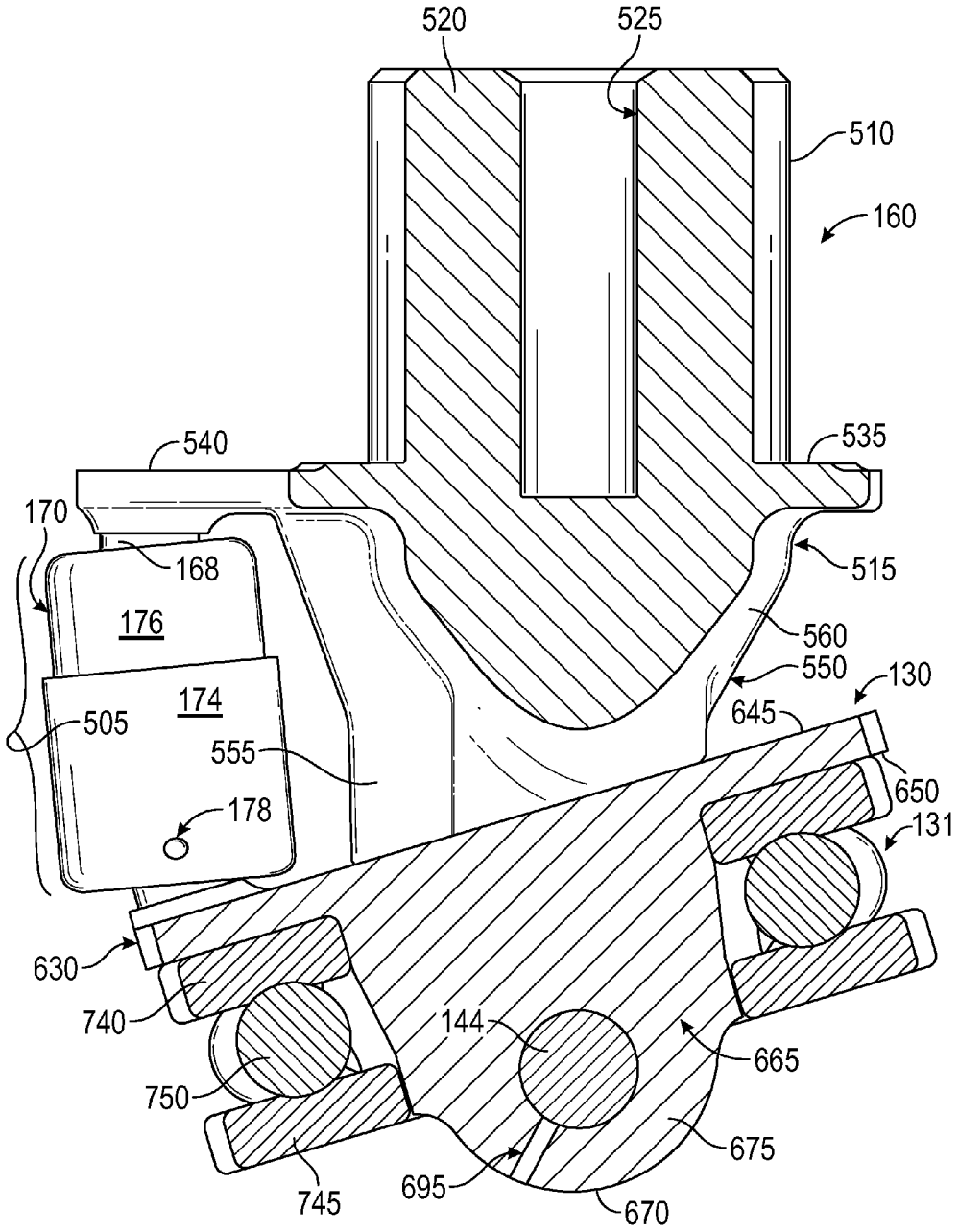
FIG. 21 is a sectional view of the cam and bearing assembly of FIG. 20.
Figure 22:
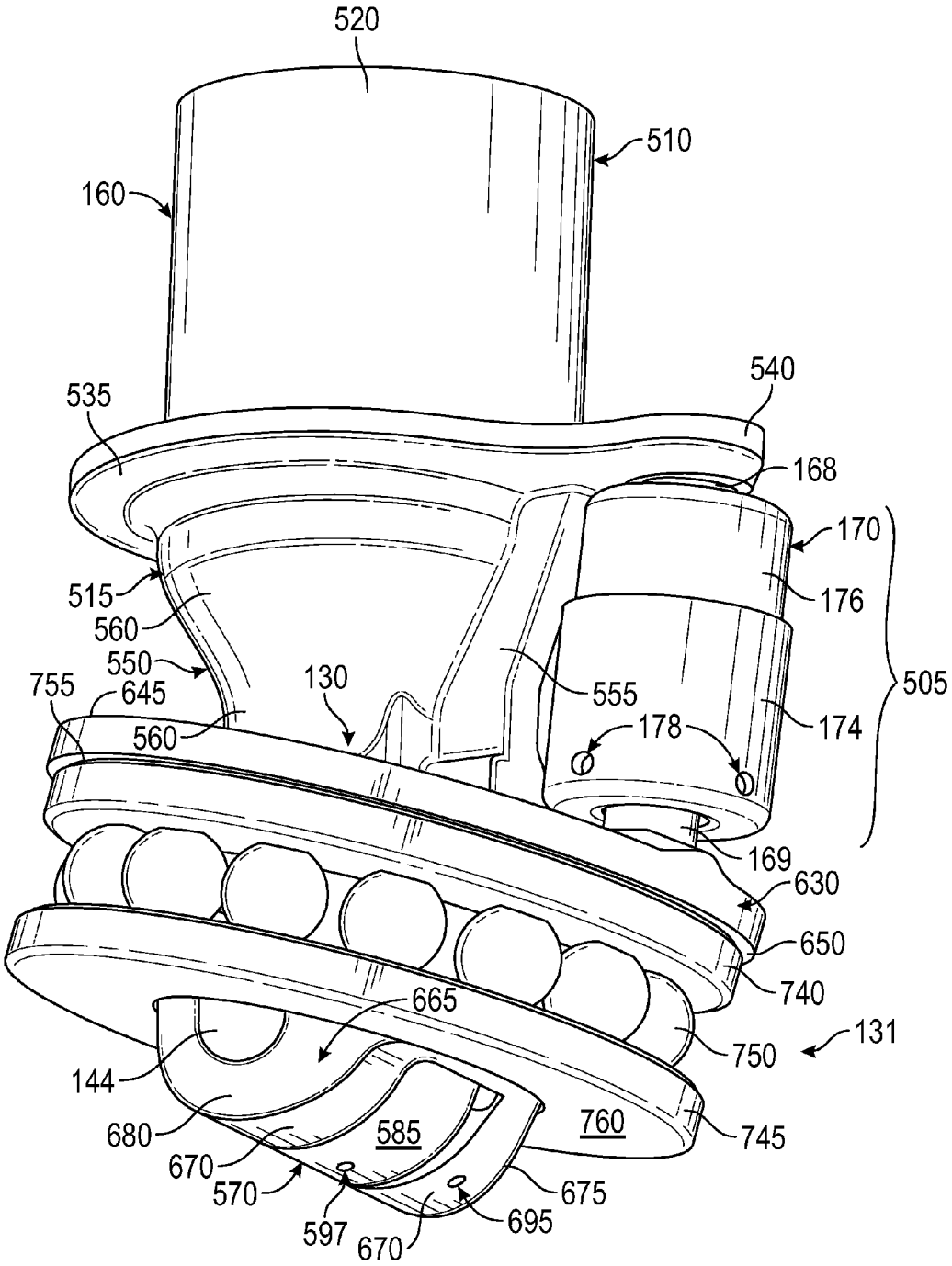
FIG. 22 is a front perspective view of the cam and bearing assembly of FIG. 20.

Referring to FIGS. 16-18, the central protrusion 635 extends axially relative to the cam axis 642 from the lower surface 650 to a tip 665. The tip 665 includes a curved bottom surface 670 and two arms 675 and 680 (FIGS. 16-17) separated by the central opening 640. A circular through-hole 685 (FIG. 17) extends through the first arm 675 and the second arm 680 and is centered on an axis of cam rotation 690 (FIGS. 17-18). The axis of cam rotation 690 is perpendicular to the cam axis 642. The through-hole 685 is sized and shaped to receive the pin 144. In an exemplary embodiment, a bushing is positioned in the through-hole and coupled to the cam 130 and the bushing is sized and shaped to receive the pin 144. Alternatively, multiple bushings are used. The bushing or bushings can be made of brass or other suitable materials. As shown in FIGS. 16 and 20-12, a first lubricant passageway 695 is formed between the bottom surface 670 of the first arm 675 and the through-hole 685 and a second lubricant passageway 700 is formed between the bottom surface 670 of the second arm 680 and the through-hole 685. The lubricant passageways 695 and 700 provide lubricant to the through-hole 685. The lubricant passageways 695 and 700 are radially spaced apart from the cam axis 642 with the first lubricant passageway 695 opposite the second lubricant passageway 700. Alternatively, the tip 665 includes more or fewer lubricant passageways. In an exemplary embodiment shown in FIGS. 20-21, when a water pump (e.g., water pump 116) including the cam assembly 500 is in use and the cam assembly 500 is rotating about the axis of PTO rotation 532, the lubricant passageways 695 and 700 are oriented in the direction of rotation such that the rotation of the cam assembly 500 forces lubricant into and through the lubricant passageways 695 and 700, thereby providing pressurized oiling of the pin 144 via the lubricant passageways 695 and 700.

Referring to FIG. 18, the central opening 640 defines the inner surfaces of the plate 630 and the central protrusion 635. A first cam contact surface 705 is defined by a portion of the central opening 640. A protrusion 710 including a second cam contact surface 715 defined by a portion of the central opening 640 is located opposite the first cam contact surface 705. In an exemplary embodiment, the protrusion 710 is located in the same radial direction from the cam axis 642 as the ball 169. The central opening 640 is sized and shaped to receive the cam-attachment portion 515 of the base 160.

In an exemplary embodiment, the pin 144 is formed from a hard, high-tensile strength material (e.g., a steel, a stainless steel).

Referring to FIGS. 17-18, the biasing member 505 includes the telescoping enclosure 170 and the spring 146. As explained above, the telescoping enclosure 170 includes two portions 174 and 176 arranged so that the second portion 176 nests inside the first portion 174. The second, upper, portion 176 includes a depression or socket 720 for receiving the ball 168 of the base 160. A lubricant passageway 725 extends through the socket 720 to allow lubricant to pass from the interior of the telescoping enclosure 170 to lubricate the ball-and-socket joint created by the ball 168 and the socket 720. The first, lower, portion 174 includes a depression or socket 730 for receiving the ball 169 of the cam 130. A lubricant passageway 735 extends through the socket 730 to allow lubricant to pass from the interior of the telescoping enclosure 170 to lubricate the ball-and-socket joint created by the ball 169 and the socket 730. As explained above, the spring 146 is contained within the telescoping enclosure 170. The spring 146 biases the two portions 174 and 176 away from each other. The biasing member 505 functions as a spring and a damper. The openings 178 in the telescoping enclosure 170 are positioned so that the openings 178 are not covered when the biasing member 505 is in an extended position (FIGS. 18 and 23) or when the biasing member 505 is in a retracted position (FIG. 24). This allows lubricant to enter and exit the biasing member 505 as needed as the biasing member 505 moves between the extended position and the retracted position.

To couple the cam assembly 500 together, the base 160 is inserted into the cam 130 so that the cam 130 encircles the cam-attachment portion 515 of the base 160. Next, the through-holes 590 and 685 are aligned and the axes of cam rotation 595 and 690 are collinear. Next, the pin 144 is inserted into the through-holes 590 and 685 so that the base 160 and the cam 130 are pivotally coupled together by the pin 144. Then, the biasing member 505 is coupled between the balls 168 and 169 to bias the cam 130 relative to the base 160.

Figure 23:
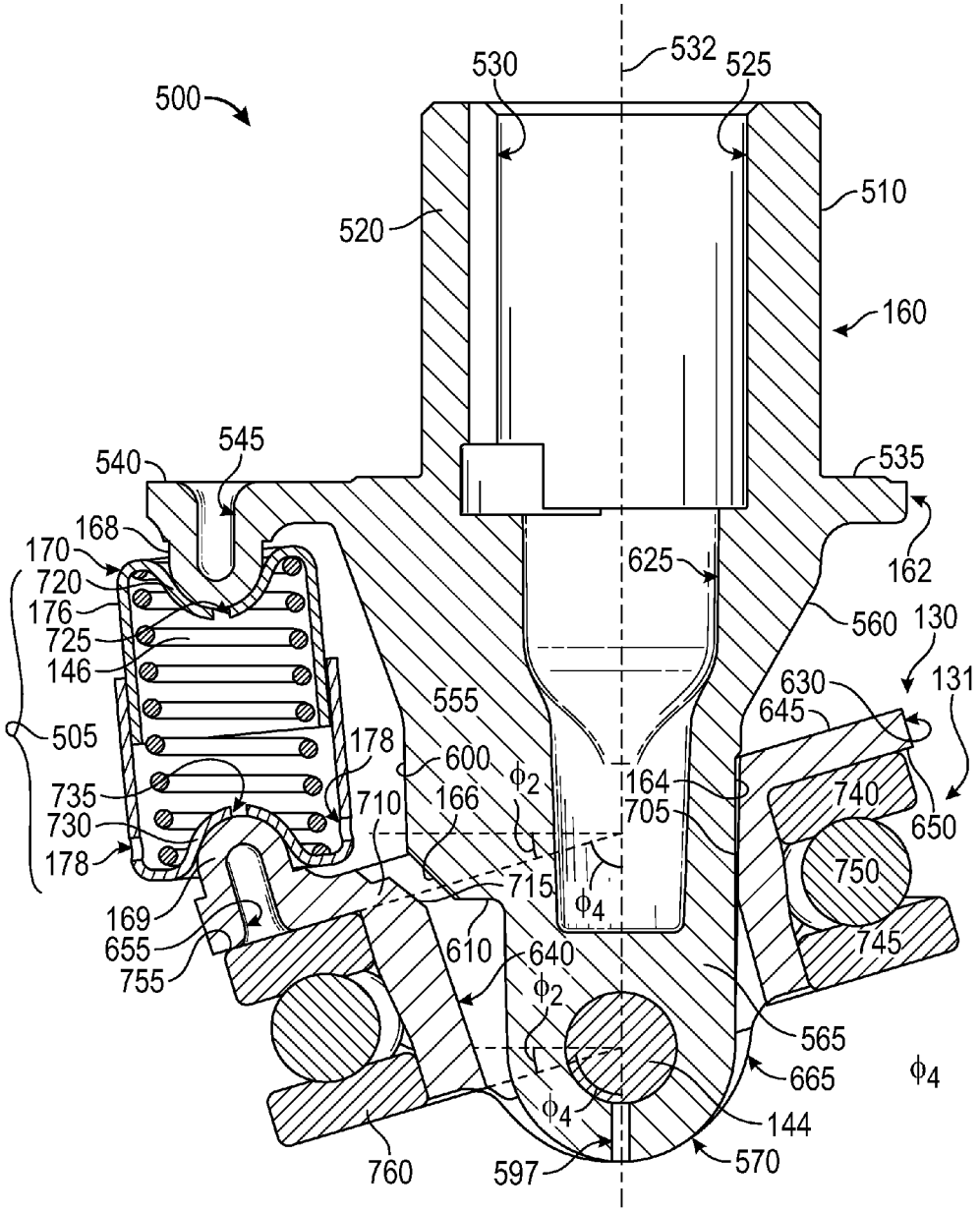
FIG. 23 is a sectional view of the cam and bearing assembly of FIG. 20 in a first operating position.
Figure 24:
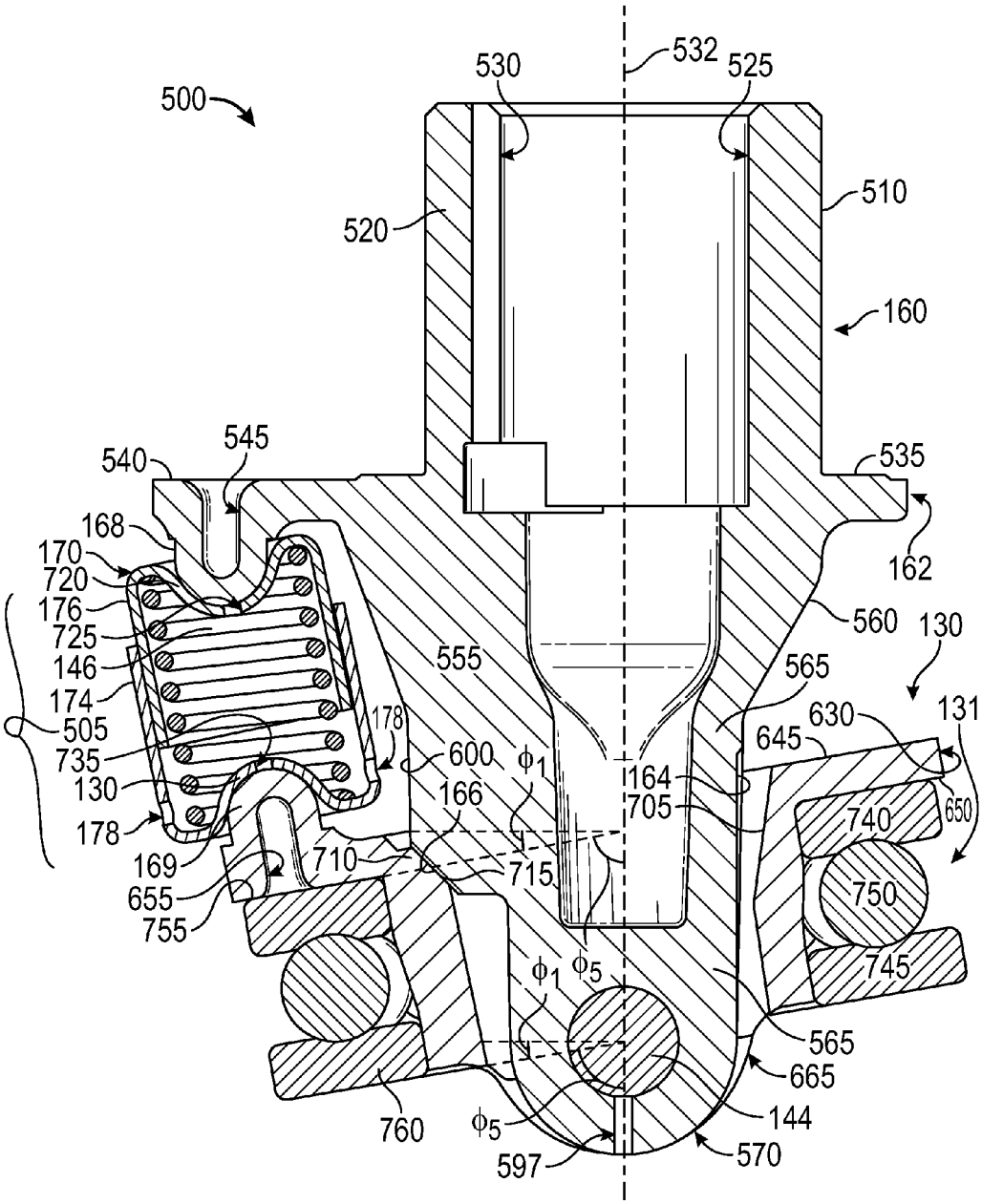
FIG. 24 is a sectional view of the cam and bearing assembly of FIG. 20 in a second operating position.

Referring to FIGS. 18 and 23, in the first operating position of the cam 130, the first contact surface 164 of the base 160 engages the first cam contact surface 705. This engagement prevents further movement of the cam 130 relative to the base 160 in the counter-clockwise direction as illustrated in FIGS. 18 and 23. As shown in FIG. 23, in the first operating position, the lower surface 650 of the cam 130 is positioned at an angle $\theta_4$ relative to the axis of PTO rotation 532. The sum of the second slant angle $\theta_2$ and the angle $\theta_4$ is ninety degrees. The first operating position is suitable for operating a water pump (e.g., water pump 116) to provide relatively low pressures and relatively high flow rates.

Referring to FIG. 24, in a second operating position of the cam 130, the second contact surface 166 of the base 160 engages the second cam contact surface 715. This engagement prevents further movement of the cam 130 relative to the base 160 in the clockwise direction as illustrated in FIG. 24. In the second operating position, the lower surface 650 of the cam 130 is positioned at an angle $\theta_5$ relative to the axis of PTO rotation 532. The sum of the first slant angle $\theta_1$ and the angle $\theta_5$ is ninety degrees. The second operating position is suitable for operating a water pump (e.g. water pump 116) to provide relatively high pressures and relatively low flow rates. The second slant angle $\theta_2$ is greater than the first slant angle $\theta_1$. The angle $\theta_5$ is greater than the angle $\theta_4$.

In an exemplary embodiment, the first slant angle $\theta_1$ is 10 degrees and the second slant angle $\theta_2$ is 16.8 degrees. This relatively small change in the position of the cam 130 relative to the axis of PTO rotation 532 roughly doubles the stroke of the pistons 128 and the displacement of the water pump 116. In other embodiments, the second slant angle $\theta_2$ has a maximum value of about 17.5 degrees.

The cam 130 is biased to the first operating position by the biasing member 505. The cam 130 is moved between the first operating position and the second operating position by a change in the back pressure operating on the cam 130. The back pressure is created in part by a spray gun (e.g., the spray gun 118) having a high pressure setting (e.g., nozzle opening (s) a having a relatively small cross-sectional area) and a high flow setting (e.g., nozzle opening(s) having a relatively large cross-sectional area. With the spray gun at the high flow setting, the back pressure from the spray gun is relatively low and the force exerted by the back pressure on the cam 130 is less than that exerted by the biasing member 505, such that the biasing member 505 is extended until the first cam contact surface 705 of the cam 130 engages the first contact surface 164 of the base 160, thereby positioning the cam 130 at the first operating position (FIG. 23). With the spray gun at the high pressure setting, the back pressure from the spray gun is relatively high and the force exerted by the back pressure on the cam 130 is greater than that exerted by the biasing member 505, such that the biasing member 505 is compressed until the second cam contact surface 715 engages the second contact surface 166 of the base 160, thereby positioning the cam 130 at the second operating position (FIG. 24). The dampening function of the biasing member 505 helps to prevent excessive oscillation of the cam 130 when transitioning between operating positions.

Figure 19:
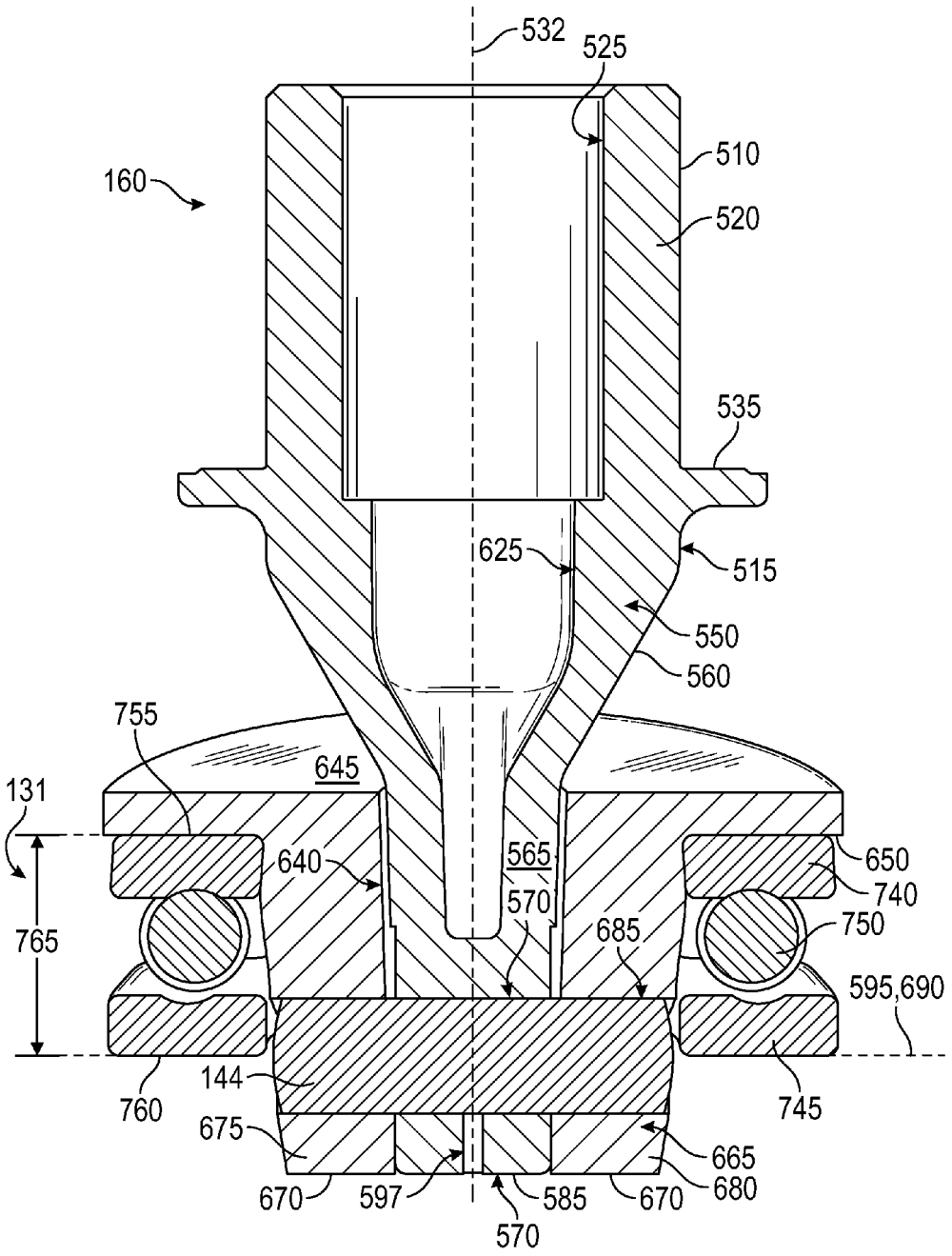
FIG. 19 is another sectional view of the cam assembly of FIG. 16.

Referring to FIGS. 19-24, a bearing device 131 is shown coupled to the cam assembly 500. As shown in FIG. 19, the bearing device 131 includes an upper race 740, a lower race 745, and multiple ball bearings 750. An upper surface 755 of the upper race 740 and a lower surface 760 of the lower race 745 are spaced apart by a bearing height 765. As shown in FIGS. 23-24, when the bearing device 131 is coupled to the cam 130 so that the upper surface 755 of the bearing device 131 engages the lower surface 650 of the cam 130, the lower surface 760 of the bearing device 131 is positioned at the same angle $\theta_4$ or $\theta_5$ relative to the axis of PTO rotation 532 as the lower surface 650 of the cam 130. Also, when the bearing device 131 is coupled to the cam 130 so that the upper surface 755 of the bearing device 131 engages the lower surface 650 of the cam 130, the lower surface 760 of the bearing device 131 and the axes of cam rotation 595 and 690 are all located in a common plane intersected by the axis of PTO rotation 532.

As shown in FIG. 2, pistons 128 ride on the lower surface 760 of the lower race 745. A tip 770 of each piston 128 has a smaller diameter than a base 775 of each piston 128 so that at either operating position of the cam 130, the pistons 128 do not contact the tip 570 of the base 160 or the tip 665 of the cam 130. In some embodiments, a water pump (e.g., water pump 116) can include more or fewer than three pistons 128. Increasing the number of pistons 128 results in increased flow and reduces pulsation at the outlet of the water pump. In an exemplary embodiment, the water pump 116 includes three pistons symmetrically arranged about the axis of PTO rotation 532, which minimizes the net torque applied to the cam 130 by the pistons 128 because the force cancellation among the pistons 128 is maximized relative to water pumps with more or fewer pistons.

Varying the strength of the spring 146 varies the output pressure a water pump (e.g., water pump 116) when the biasing member 505 is in the contracted position (FIG. 24) with the cam 130 at the second slant angle $\theta_2$. In an exemplary embodiment, the output pressure of a water pump at the high flow setting is between 100 and 500 psi. By increasing the strength of the spring 146, the maximum output pressure with the cam 130 in the first operating position (FIG. 23) could be raised to about 750 psi.

The construction and arrangements of the water pump, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A water pump for use with a prime mover having a power takeoff that rotates about an axis of PTO rotation, the water pump operable at two operating conditions and comprising:

a base including a PTO-attachment portion, a base plate, and a cam-attachment portion, wherein the PTO-attachment portion is configured to be coupled to a power takeoff for rotation about an axis of PTO rotation, the base plate is positioned between the PTO-attachment portion and the cam-attachment portion, and the cam-attachment portion includes a first contact surface spaced a first perpendicular distance from the axis of PTO rotation and a second contact surface spaced a second perpendicular distance, different than the first perpendicular distance, from the axis of PTO rotation;

a cam including a cam plate, a central opening, a first cam contact surface, and a second cam contact surface, wherein the cam-attachment portion of the base extends into the central opening;

a bearing including a bearing surface, wherein the bearing is coupled to the cam plate;

a joint pivotally coupling the cam to the cam-attachment portion of the base so that the cam is pivotable relative to the base about an axis of cam rotation perpendicular to the axis of PTO rotation, wherein the bearing surface and the axis of cam rotation are found in a common plane; and a piston for pumping water, wherein the piston engages the bearing surface;

wherein in a first operating position of the cam, corresponding to a first operating condition of the water pump, the first contact surface engages the first cam contact surface so that the bearing surface is positioned at a first angle relative to the axis of PTO rotation; and wherein in a second operating position of the cam, corresponding to a second operating condition of the water pump, the second contact surface engages the second cam contact surface so that the bearing surface is positioned at a second angle, greater than the first angle, relative to the axis of PTO rotation.

2. The water pump of claim 1, further comprising:

a biasing member coupled between the base plate and the cam plate to bias the cam to the first operating position.

3. The water pump of claim 2, wherein the biasing member comprises an enclosure having a first portion and a second portion nested inside the first portion in a telescoping relationship and a spring positioned inside the enclosure.

4. The water pump of claim 3, wherein the enclosure includes a lubricant passageway that allows lubricant to enter and exit the enclosure.

5. The water pump of claim 2, wherein in the first operating condition, a first back pressure operates on the cam and in the second operating condition, a second back pressure, greater than the first back pressure, operates on the cam.

6. The water pump of claim 1, wherein the joint comprises a pin and the pin extends along and is centered on the axis of cam rotation.

7. The water pump of claim 1, wherein the central opening defines the first cam contact surface and the second cam contact surface.

8. The water pump of claim 7, wherein the first cam contact surface is located opposite the second cam contact surface.

9. The water pump of claim 1, wherein the cam encircles the cam-attachment portion of the base.

* * * * *